US011667414B2

(12) United States Patent
Tsuruta et al.

(10) Patent No.: US 11,667,414 B2
(45) Date of Patent: Jun. 6, 2023

(54) VERTICAL BAG-MAKING/FILLING/PACKAGING MACHINE, MANUFACTURING METHOD OF FILM PACKAGING BAG WITH CONTENT

(71) Applicant: ORIHIRO ENGINEERING CO., LTD., Tomioka (JP)

(72) Inventors: Masataka Tsuruta, Tomioka (JP); Akira Yamaguchi, Tomioka (JP); Takayuki Yokoyama, Tomioka (JP)

(73) Assignee: ORIHIRO ENGINEERING CO., LTD., Tomioka (JP)

( * ) Notice: Subject to any disclaimer, the term of this patent is extended or adjusted under 35 U.S.C. 154(b) by 0 days.

(21) Appl. No.: 17/916,853

(22) PCT Filed: Feb. 4, 2022

(86) PCT No.: PCT/JP2022/004371

§ 371 (c)(1),
(2) Date: Oct. 4, 2022

(87) PCT Pub. No.: WO2022/176644

PCT Pub. Date: Aug. 25, 2022

(65) Prior Publication Data

US 2023/0129567 A1 Apr. 27, 2023

(30) Foreign Application Priority Data

Feb. 18, 2021 (JP) ..... JP2021-023889

(51) Int. Cl.
*B65B 9/093* (2012.01)
*B65B 61/06* (2006.01)
(Continued)

(52) U.S. Cl.
CPC ..... *B65B 9/093* (2013.01); *B65B 41/16* (2013.01); *B65B 51/146* (2013.01); *B65B 61/06* (2013.01)

(58) Field of Classification Search
CPC ..... B65B 9/093; B65B 41/16; B65B 51/146; B65B 41/00; B65B 41/02; B65B 41/10;
(Continued)

(56) References Cited

U.S. PATENT DOCUMENTS 4,587,795 A * 5/1986 Yamashita ..... B65B 9/213 53/554
5,255,497 A * 10/1993 Zoromski ..... B65B 9/2042 53/551
(Continued)

FOREIGN PATENT DOCUMENTS

JP H06-022204 A 1/1994
JP 2006-096359 A 4/2006
(Continued)

OTHER PUBLICATIONS

International Search Report dated Mar. 22, 2022, issued in counterpart internatioanl application No. PCT/JP2022/004371.
(Continued)

*Primary Examiner* — Anna K Kinsaul
*Assistant Examiner* — Veronica Martin
(74) *Attorney, Agent, or Firm* — WHDA, LLP

(57) ABSTRACT

A vertical bag-making/filling/packaging machine (1) comprises: a film supplying portion (5) which lets out a film (F) from a roll (Fr); a bag-making guide (31) which folds the film (F) into a tubular shape and changes a conveying direction downward; a vertical sealing portion (60) which thermally seals side edges of the film (F) to each other in an up-down direction so as to make the film into a tubular shape; a film conveying portion (50) which conveys the film (F) downward; a filling portion (70) which loads a content (X) into an interior of the film (F); a lateral sealing portion (80) which thermally seals the film (F) in a left-right direction so as to make a bag body; a square-bottom sealing portion (90) which expands a bottom of the bag body to a rectangular shape from an inside and then thermally seals the bottom to form a rectangular bottom surface; and a cutter (89) which cuts off the bag body from the film (F).

14 Claims, 13 Drawing Sheets

(51) Int. Cl.
*B65B 51/14* (2006.01)
*B65B 41/16* (2006.01)

(58) Field of Classification Search
CPC ..... B65B 41/12; B65B 9/213; B65B 9/2042; B65B 51/303; B65B 9/2056; B65B 9/2049; B29C 66/4312; B29C 66/1122; B29C 66/4322; B29C 66/83221; B29C 65/18; B29C 66/849
See application file for complete search history.

(56) References Cited

U.S. PATENT DOCUMENTS

| | | | | |
|---|---|---|---|---|
| 7,299,608 | B2 * | 11/2007 | Kohl | B65B 9/213 53/551 |
| 2020/0087009 | A1 * | 3/2020 | Tsuruta | B65B 3/28 |

FOREIGN PATENT DOCUMENTS

| | | | |
|---|---|---|---|
| JP | 2008-087777 | A | 4/2008 |
| JP | 2010-006383 | A | 1/2010 |
| JP | 5231098 | B2 | 7/2013 |
| JP | 2013-252901 | A | 12/2013 |
| JP | 2017-043374 | A | 3/2017 |
| JP | 2018-203364 | A | 12/2018 |

OTHER PUBLICATIONS

Japanese Office Action, Notice of Reasons for Refusal dated May 20, 2022, issued in counterpart application No. JP2021-023889.

* cited by examiner (a)

(b)

VERTICAL BAG-MAKING/FILLING/PACKAGING MACHINE, MANUFACTURING METHOD OF FILM PACKAGING BAG WITH CONTENT

TECHNICAL FIELD

The present invention relates to a vertical bag-making/filling/packaging machine which forms a bag body having a rectangular bottom surface from a plastic film and fills a content such as a liquid or a fluid therein. The present invention particularly relates to a vertical bag-making/filling/packaging machine which automatically performs box-packing after forming a film packaging bag with a large capacity from a plastic film with low toughness and filling the content.

BACKGROUND ART

The vertical bag-making/filling/packaging machine forms a bag body from a band-shaped plastic film and fills a content in this bag body so as to continuously manufacture a film packaging bag with the content sealed therein. The vertical bag-making/filling/packaging machine is often used for automatic packaging of food.

In view of food hygiene or the like, it is required for the vertical bag-making/filling/packaging machine that, after the film packaging bag with the content sealed therein is manufactured, this film packaging bag is automatically thrown (packed) in a cardboard box or the like for transport.

Generally, for the film packaging bag consumed in a restaurant and the like and filled with foods for business purposes, inexpensive plastic films (co-extruded polyethylene multilayered film, low-density polyethylene single-layered film and the like) are used. Such plastic films are thin and have low toughness (stickiness) and thus, when the film packaging bag is thrown in a cardboard box or the like, both corner parts on a bag bottom are deformed and bent irregularly.

When food which is solidified when cooled (butter, chocolate, fat and oil and the like) is filled in this film packaging bag, it becomes difficult to take out the contents from both corner parts on the bag bottom. Since the film on the both corner parts bites the cooled and solidified contents, when the contents are taken out of the film packaging bag, the film is torn off and left in the contents. In order to avoid mixing of foreign substances in the food, the content filled in the both corner parts on the bag bottom should be discarded.

Thus, there is a need for the vertical bag-making/filling/packaging machine that can manufacture the film packaging bag having a square bottom surface and suitable for box packing by using a plastic film with low toughness.

CITATION LIST

Patent Literature

Patent Literature 1: Japanese Patent No. 5231098

SUMMARY OF INVENTION

Technical Problem

The vertical bag-making/filling/packaging machine in Patent Literature 1 causes a lateral sealing portion, a square-tube molding guide cylinder, and a triangular flap-forming member to collaborate with one another so as to fold a bag bottom of a packaging bag and forms a rectangular bottom surface. While a film is conveyed along the square-tube molding guide cylinder, the film between the square-tube molding guide cylinder and the lateral sealing portion is pressed by the triangular flap-forming member. The bag bottom of the packaging bag is favorably folded into a square because a plastic film with high toughness such as an aluminum-foil film and a dry-laminate multilayered film is used.

However, when the aforementioned low-toughness film is used, the film is loosened easily and thus, when the bag bottom is folded, wrinkles are generated on a bottom surface of the film packaging bag. Particularly when a film packaging bag with a large capacity is to be formed, since a distance between the square-tube molding guide cylinder and the lateral sealing portion becomes large, even if a high-toughness film is used, there is a problem that the bag bottom cannot be folded stably without wrinkles.

Moreover, since the square-tube molding guide cylinder has a large surface area, there is a good possibility that contents adhere thereto. Thus, it is required that the square-tube molding guide cylinder is regularly removed and washed. Particularly when food with high viscosity is filled, the washing of the square-tube molding guide cylinder needs to be performed frequently.

However, there is a problem that attaching/removing of the square-tube molding guide cylinder is not easy, which is poor in maintenance performances.

The present invention has an object to provide a vertical bag-making/filling/packaging machine which folds a bag bottom into a rectangle without wrinkles and can efficiently manufacture a film packaging bag filled with contents.

Solution to Problem

An aspect of a vertical bag-making/filling/packaging machine according to the present invention is characterized by including: a film supplying portion which lets out a film from a roll; a bag-making guide which folds the film into a tubular shape and changes a conveying direction downward; a vertical sealing portion which thermally seals side edges of the film to each other in an up-down direction so as to make the film into a tubular shape; a film conveying portion which conveys the film downward; a filling portion which loads a content into an interior of the film; a lateral sealing portion which thermally seals the film in a left-right direction so as to make a bag body; a square-bottom sealing portion which expands a bottom of the bag body to a rectangular shape from the inside and thermally seals the bottom to make a rectangular bottom surface; and a cutter which cuts off the bag body from the film.

This aspect is characterized in that the square-bottom sealing portion includes: a square-bottom molding portion which expands a bottom part of the bag body into a rectangular shape from the inside and folds both corner parts of the bag body into a triangle; and a square-bottom heater which thermally seals the both corner parts in a front-back direction.

This aspect is characterized in that the square-bottom heater thermally seals the both corner parts on an upper surface of the lateral sealing portion in the front-back direction.

This aspect is characterized in that the square-bottom molding portion includes four first guide rods in contact with an inner surface of the film and a first-guide-rod driving portion which moves the four first guide rods in four corner directions.

This aspect is characterized in that the first-guide-rod driving portion lowers and moves the four first guide rods to an operating position, which is on the outer side in the four corner direction and is close to the square-bottom heater, while keeping them in contact with the inner side of the film and raises and moves the four first guide rods to a retreated position, which is on the inner side in the four corner direction and is apart from the square-bottom heater, so as to disable contact with the inner side of the film.

This aspect is characterized in that the film conveying portion conveys the film in a downward direction in accordance with a folded amount of the both corner parts when the four first guide rods move from the retreated position to the operating position.

This aspect is characterized in that the lateral sealing portion includes a flat molding portion which flattens the film and a lateral heater which sandwiches the film in a left-right direction and thermally seals it.

This aspect is characterized in that the flat molding portion includes two second guide rods brought into contact with the inner surface of the film and a second-guide-rod driving portion which moves the two second guide rods in the left-right direction.

This aspect is characterized in that it includes: a film clamp which holds the film on the bag-making guide; a film tension releasing portion which loosens the film laid between the film supplying portion and the bag-making guide; and a weighing portion which supports the bag-making guide and weighs the content.

This aspect is characterized in that the weighing portion includes a pair of load cells, and the bag-making guide is laid over the pair of load cells.

This aspect is characterized in that it includes a pair of deaerating plates which is disposed immediately below the lateral sealing portion and regulates a thickness of the bag body when the lateral sealing portion is operated.

This aspect is characterized in that it includes a bag supporting portion disposed below the lateral sealing portion and supporting a bottom of the bag body when the lateral sealing portion is operated, and the bag supporting portion conveys the bag body toward a bag-body carrying-out portion after the cutter is operated.

This aspect is characterized in that the bag supporting portion includes a conveyor, and the conveyor is swung downward so as to slide the bag body down.

This aspect is characterized in that the bag-body carrying-out portion conveys an accommodating box below the bag supporting portion, and the bag supporting portion swings the conveyor so as to open an upper lid of the accommodating box widely.

This aspect is characterized in that the film is a co-extruded polyethylene multilayered film or a low-density polyethylene single-layered film.

An aspect of a manufacturing method of the film packaging bag with contents according to the present invention is characterized by having: a film forming step in which a film let out from a roll is folded into a tubular shape; a vertical sealing step in which side edges of the film are thermally sealed to each other in up-down direction so as to form a tubular shape; a film conveying step in which the film is conveyed downward; a filling step in which the content is loaded into an interior of the film; a lateral sealing step in which the film is thermally sealed in a lateral direction so as to make a bag body; a square-bottom sealing step in which a bottom of the bag body is expanded to a rectangular shape from the inside and then thermally sealed to form a rectangular bottom surface; and a bag-body cutting-off step in which the bag body is cut off from the film.

Advantageous Effects of Invention

According to the present invention, the vertical bag-making/filling/packaging machine which can manufacture a film packaging bag filled with contents by forming a rectangular bottom surface without wrinkles can be realized. Particularly, even when a film packaging bag is to be formed from a low-toughness film or a film packaging bag with a large capacity is to be formed, the bag bottom can be folded into a rectangle without generating wrinkles.

DESCRIPTION OF EMBODIMENTS

A vertical bag-making/filling/packaging machine 1 and a manufacturing method of a film packaging bag G with contents according to an embodiment of the present invention will be described below.

[Film Packaging Bag G with Contents]

Figure 1:
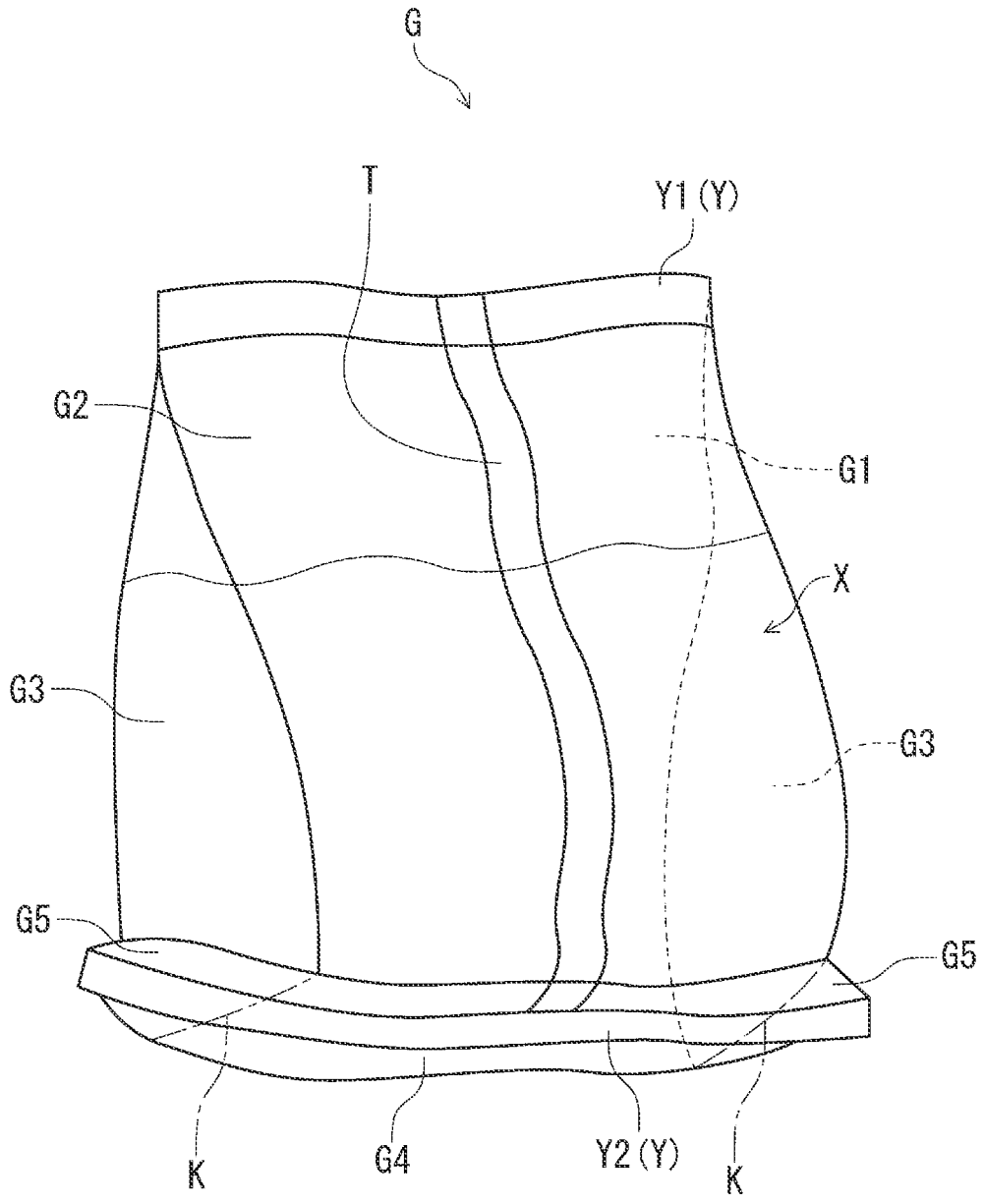
FIG. 1 is a perspective view illustrating a film packaging bag with contents according to an embodiment.

FIG. 1 is a perspective view illustrating a film packaging bag G with contents (a view seen from lower rear).

The film packaging bag G with contents is a so-called pillow-shaped packaging bag (bag body) formed from a single plastic film F, which is filled with the content X. The film packaging bag G is a so-called packaging bag for professional use and is filled with food or the like to be consumed in a large quantity at shops and the like. The film packaging bag G is a packaging bag with a large capacity, whose accommodated amount (filled amount) of the content X is 1 L or more, for example.

A height direction when the film packaging bag G with contents is brought into a standing attitude is also called an up-down direction. A width direction of the film packaging bag G with contents is also called a left-right direction. A thickness direction of the film packaging bag G with contents is also called a front-back direction.

For the film packaging bag G, an upper end thereof has a flat shape extending in the left-right direction, and a lower end thereof has a square (rectangular) shape expanding in the front-back and left-right directions (horizontal direction).

Specifically, the film packaging bag G has an inverted trapezoidal shaped front surface G1, a rear surface G2, a pair of elongated triangular side surfaces G3, and a square-shaped bottom surface G4. By means of each of these surfaces G1 to G4, an accommodating space accommodating (filled with) the content X is formed. Since the film packaging bag G is made of a flexible film F, when the film packaging bag G is filled with the content X, each of the surfaces G1 to G4 is curved or expanded, and boundaries among each of the surfaces G1 to G4 becomes unclear (blurred).

Moreover, the film packaging bag G has two flaps G5 connecting each of the side surfaces G3 and the bottom surface G4. The flap G5 has a triangular shape and is sealed from the accommodating space so that the content X is not filled therein.

On the upper end of the film packaging bag G, a lateral seal Y1 extending in the left-right direction is provided. The lateral seal Y1 welds the front surface G1 and the rear surface G2.

At a center in the left-right direction of the rear surface G2, a vertical seal T extending in the up-down direction is provided. The vertical seal T welds side edges (a right side and a left side of the rear surface G2) of a single plastic film F to each other. The vertical seal T is also called a back-pasting seal. An upper end of the vertical seal T is connected (welded) to the lateral seal Y1. A lower end of the vertical seal T extends to a center of the bottom surface G4.

At the center of the bottom surface G4, a lateral seal Y2 extending in the left-right direction is provided. The lateral seal Y2 welds a front side and a rear side of the bottom surface G4. A center of the lateral seal Y2 is connected (welded) to the lower end of the vertical seal T. Both ends in the left-right direction of the lateral seal Y2 extend to distal ends of the flap G5 (both corners of the bag body).

On boundaries among the side surface G3, the bottom surface G4, and the flap G5, a pair of square bottom seals K extending in the front-back direction are provided. A center of the square bottom seal K is connected (welded) to the lateral seal Y2. The pair of square bottom seals K seal the flap G5 and the accommodating space.

The film F is an inexpensive film such as a co-extruded polyethylene multilayered film and a low-density polyethylene single-layered film, for example. These plastic films are thin and have low toughness (stickiness). The low toughness is expressed as "weak waist" in Japanese. By using such film F, the inexpensive film packaging bag G with mechanical strength kept to required minimum is manufactured.

The content X is a liquid or a paste-state (semi-solid) beverage, food or the like. Specifically, the content X is a liquid such as drinking water and liquid egg or a fluid such as margarine, shortening, chocolate, fat and oil.

Since chocolate, fat and oil or the like is solidified when cooled, if it is filled in the normal pillow-shaped film packaging bag, it is solidified in the both corner parts of the bag bottom and cannot be taken out easily.

Since the film packaging bag G has a rectangular bag bottom (bottom surface G4) and does not have the both corner parts (the flap G5 is formed), it does not become impossible to take out the content X such as chocolate, fat and oil.

[Vertical Bag-Making/Filling/Packaging Machine 1]

Figure 2:
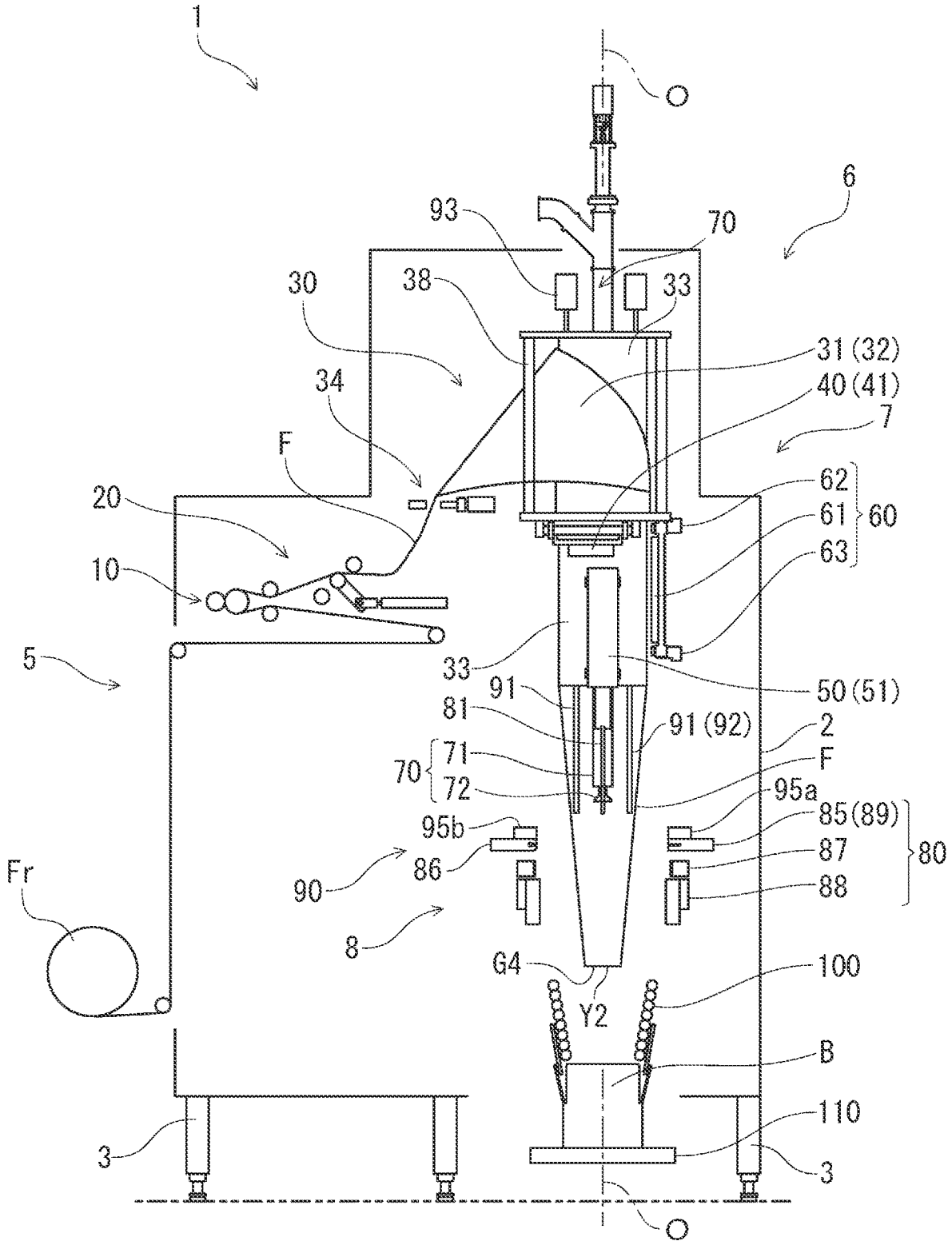
FIG. 2 is a side view of a vertical bag-making/filling/packaging machine 1 according to the embodiment.
Figure 3:
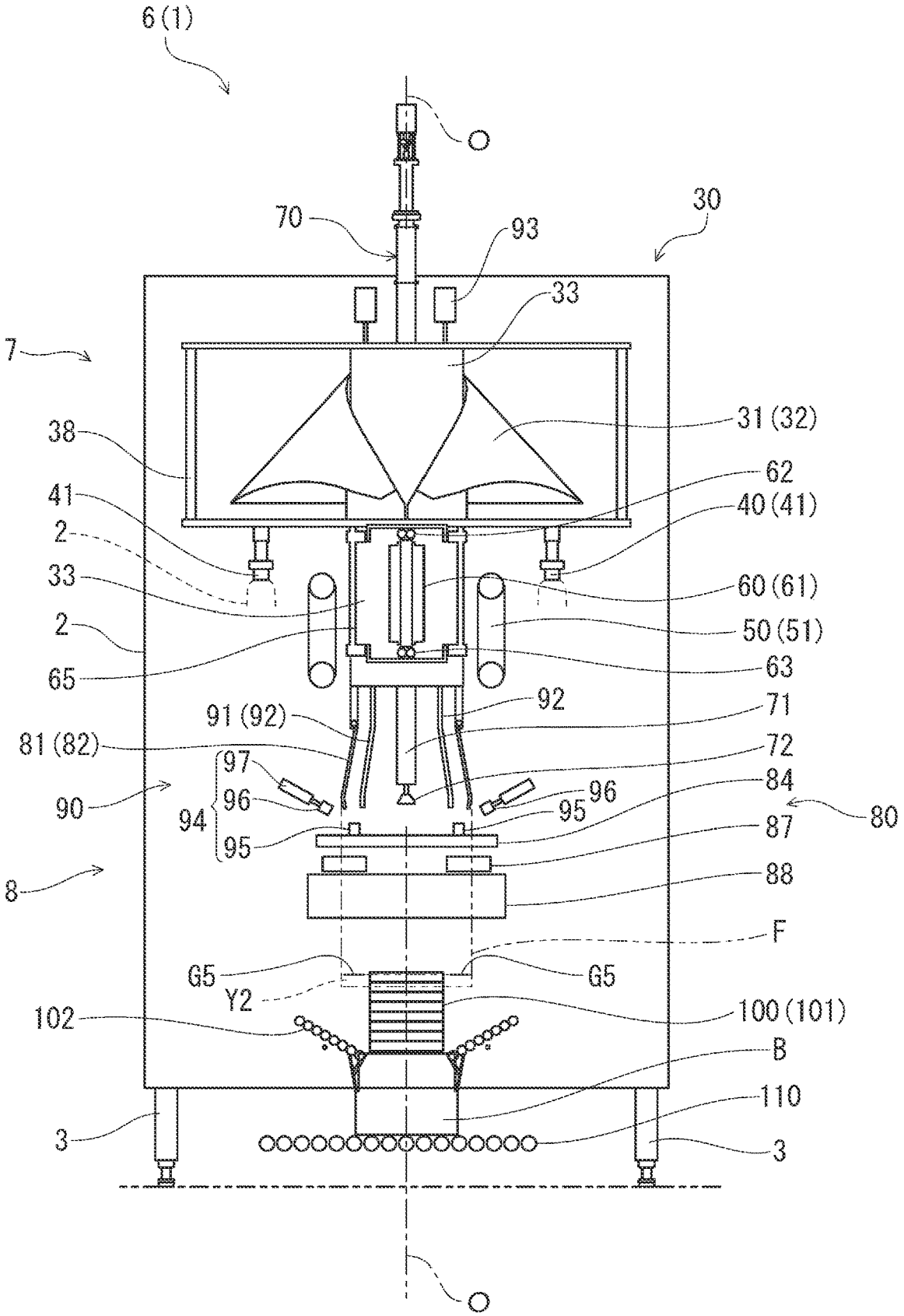
FIG. 3 is a front view of the vertical bag-making/filling/packaging machine 1 (bag-making/filling/packaging portion 6) according to the embodiment of the present invention.

FIG. 2 is a side view of a vertical bag-making/filling/packaging machine 1. FIG. 3 is a front view of the vertical bag-making/filling/packaging machine 1 (bag-making/filling/packaging portion 6).

The vertical bag-making/filling/packaging machine 1 forms a film packaging bag (bag body) G of a pillow shape from a band-shaped film F and fills a content X in this film packaging bag G at the same time.

The vertical bag-making/filling/packaging machine 1 fills the content X while intermittently conveying the film F downward under control of a control portion (not shown). The vertical bag-making/filling/packaging machine 1 fills the content X substantially fully so that air is not left in the film packaging bag G as much as possible.

The vertical bag-making/filling/packaging machine 1 fills the content X in the film packaging bag G while weighing it. The vertical bag-making/filling/packaging machine 1 makes a weight (a filled amount, a loaded amount) of the content X constant with accuracy. The vertical bag-making/filling/packaging machine 1 continuously manufactures the film packaging bag G excellent in quantitativity of the content.

A longitudinal direction of the film F is also called a conveying direction. A width direction of the film F is also called a lateral direction.

The longitudinal direction of the film F in the vertical bag-making/filling/packaging portion 6 is also called a perpendicular direction, an up-down direction or a vertical direction. The lateral direction of the film F in the bag-making/filling/packaging portion 6 is also called a right-and-left direction. The thickness direction of the film F in the bag-making/filling/packaging portion 6 is also called a front-back direction.

Among the directions (horizontal radiation directions) intersecting a center axis O of a bag-making guide 31, the following four directions are referred to as four corner directions: a front-left direction, a front-right direction, a rear-left direction, and a rear-right direction.

A direction getting closer to the center axis O is referred to as an inside, and a direction separating away from the center axis O is referred to as an outside.

As illustrated in FIGS. 2 and 3, the vertical bag-making/filling/packaging machine 1 includes a film supplying portion 5 and the bag-making/filling/packaging portion 6. The vertical bag-making/filling/packaging machine 1 is provided with conveyor 110.

The film supplying portion 5 is disposed on a rear, while the bag-making/filling/packaging portion 6 is disposed on a front. The film supplying portion 5 and the bag-making/filling/packaging portion 6 are disposed inside an apparatus frame 2. The apparatus frame 2 is installed on a floor surface through a leg portion 3.

[Film Supplying Portion 5]

The film supplying portion 5 supplies the film F toward the bag-making/filling/packaging portion 6.

The film supplying portion 5 includes a plurality of driven rollers, a conveying roller pair 10, a film tension releasing portion 20 and the like.

The film supplying portion 5 pivotally supports the film F (roll Fr) wound in a roll state. The film supplying portion 5 lets out the film F from the roll Fr and passes it through the plurality of rollers and the like. The film supplying portion 5 feeds out the film F with a constant tension applied so that it is not loosened or meandered.

In the film supplying portion 5, the film tension releasing portion 20 is disposed on a lowermost stream in the conveying direction of the film F. The conveying roller pair 10 is disposed immediately on an upstream of the film tension releasing portion 20.

<Conveying Roller Pair 10>

The conveying roller pair 10 is composed of a driving roller 11 and a driven roller 12. The driving roller 11 and the driven roller 12 are disposed in parallel in close contact with each other. The driving roller 11 is rotated/driven by a driving motor 13.

The conveying roller pair 10 feeds out the film F while sandwiching the film F at all times by the driving roller 11 and the driven roller 12.

<Film Tension Releasing Portion 20>

Figure 4:
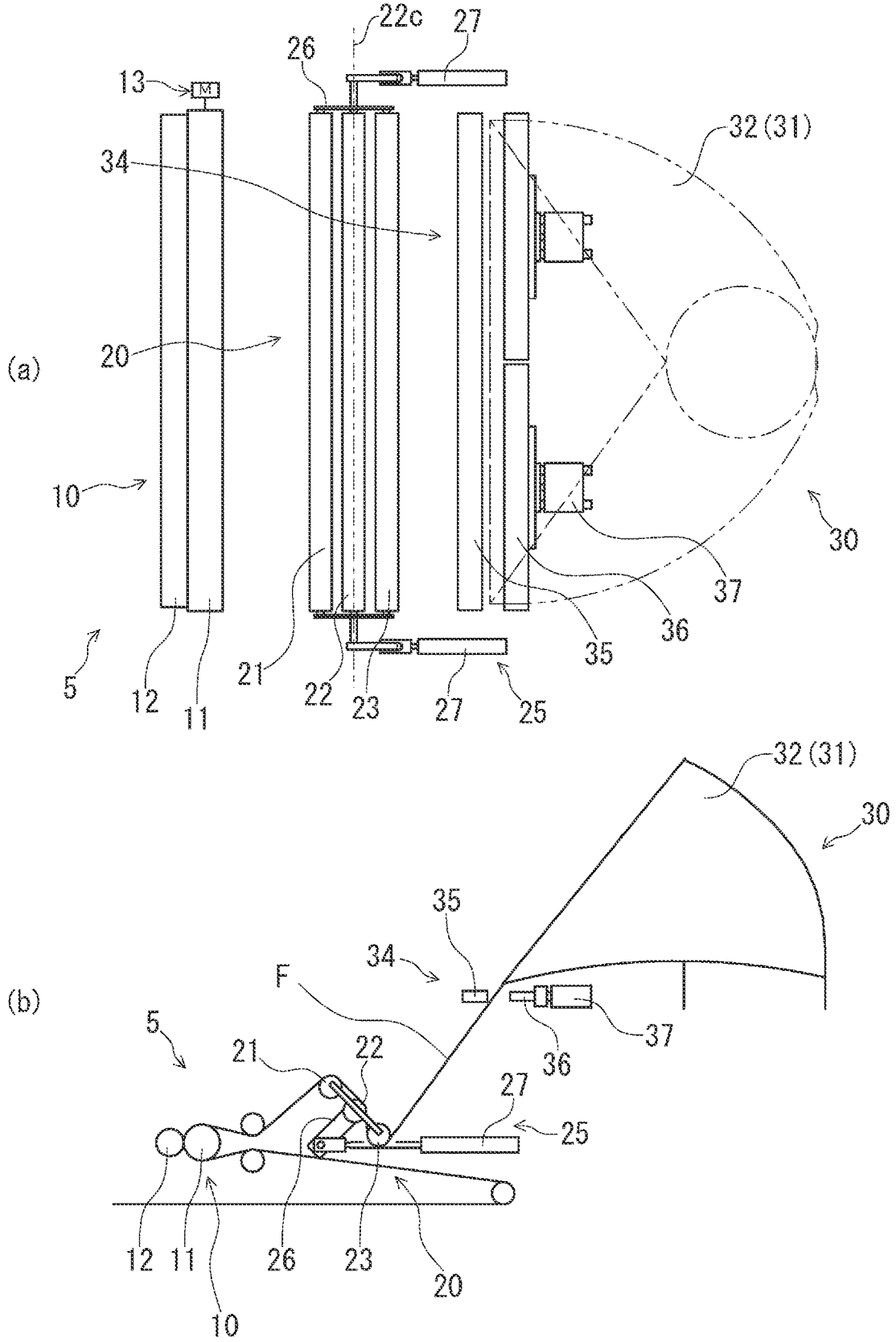
FIG. 4 are views illustrating a film tension releasing portion 20, in which FIG. 4(*a*) is a plan view and FIG. 4(*b*) is a side view.

FIG. 4 are views illustrating the film tension releasing portion 20, in which FIG. 4(*a*) is a plan view and FIG. 4(*b*) is a side view.

The film tension releasing portion 20 includes three driven rollers 21, 22 and 23 and a roller moving portion 25 for moving the driven rollers 21, 22, and 23.

The driven rollers 21, 22, and 23 are disposed separately from each other in parallel. The driven rollers 21, 22, and 23 are disposed at an equal interval, and the film F is laid over them.

The driven rollers 21 and 22 are in close contact with an outer surface of the film F. The driven roller 23 is in close contact with an inner surface of the film F. The outer surface of the film F becomes an outer surface of the film packaging bag G, and the inner surface of the film F becomes an inner surface of the film packaging bag G.

The roller moving portion 25 brings the driven rollers 21, 22, and 23 into close contact with the film F or detaches them from the film F. The roller moving portion 25 includes a supporting member 26 which supports the driven rollers 21, 22, and 23, capable of being driven/rotating, and an air cylinder 27 which drives the supporting member 26.

The supporting member 26 pivotally supports the driven rollers 21, 22, and 23. The supporting member 26 is supported rotatably around a rotating shaft 22*c* of the driven roller 22 with respect to the apparatus frame 2.

The air cylinder 27 is disposed on the outer surface side of the film F and is connected to the supporting member 26. The air cylinder 27 gives a rotating force around the rotating shaft 22*c* to the supporting member 26. That is, the air cylinder 27 rotates (revolves) the driven rollers 21, 23 around the rotating shaft 22*c*.

When the driven rollers 21, 23 are rotated around the rotating shaft 22*c*, the driven rollers 21, 23 are brought into close contact with the film F or are detached therefrom. As a result, the roller moving portion 25 applies a tension to the film F or releases the tension.

The film F is fed out obliquely upward from the film supplying portion 5. The film F is conveyed toward an upper end of the bag-making/filling/packaging portion 6 (a bag-making guide 31 which will be described later) from the film supplying portion 5. The conveying direction of the film F is changed to a downward direction at the upper end of the bag-making/filling/packaging portion 6.

[Bag-Making/Filling/Packaging Portion 6]

The bag-making/filling/packaging portion 6 forms the film packaging bag G on the lower end of the film F while feeding the film F downward (in a vertical direction). The bag-making/filling/packaging portion 6 fills the content X in the film packaging bag G while weighing it. The bag-making/filling/packaging portion 6 separates the film packaging bag G from the film F and continuously manufactures the film packaging bag G in which the content X is filled (film packaging bag G with contents).

The bag-making/filling/packaging portion 6 includes a bag making portion 7, a filling/packaging portion 8 and the like.

The bag making portion 7 is disposed above, while the filling/packaging portion 8 is disposed below. The film F is fed to the filling/packaging portion 8 via the bag making portion 7. The bag making portion 7 forms the tubular film F, and the filling/packaging portion 8 manufactures the film packaging bag G in which the content X is filled.

[Bag Making Portion 7]

The bag making portion 7 forms the film F into the tubular shape while feeding the film F in the vertical direction (downward direction). The bag making portion 7 includes a bag-making guide unit 30, a weighing portion 40, a film conveying portion 50, and a vertical sealing portion 60.

<Bag-Making Guide Unit 30>

The bag-making guide unit 30 includes the bag-making guide 31, a film clamp 34, and a support frame 38.

The bag-making guide unit 30 folds the film F into the tubular shape. Moreover, the bag-making guide unit 30 holds the tubular film F in a state suspended to the downward direction.

The bag-making guide 31 is brought into close contact with the film F supplied from the film supplying portion 5 (slides the film F) and changes the conveying direction from the obliquely upward direction to the downward direction while folding the film F into the tubular shape. The bag-making guide 31 includes a sailor suit-like portion 32 and a pipe portion 33.

The sailor suit-like portion 32 is a member in which a thin plate made of stainless steel is folded like a collar of a sailor suit, and an upstream side is formed into a flat plate shape, while a downstream side into a cylindrical shape. The downstream side of the sailor suit-like portion 32 extends in the up-down direction.

The pipe portion 33 is a cylindrical body made of stainless steel and is fitted into the downstream side (a cylindrical part) of the sailor suit-like portion 32. The pipe portion 33 is disposed along the up-down direction, and a slight gap is provided between the pipe portion 33 and the sailor suit-like portion 32. The pipe portion 33 has an upper end protruding slightly above the sailor suit-like portion 32 and a lower end extending below the sailor suit-like portion 32.

The film F is conveyed along the upper surface of the sailor suit-like portion 32 and is inserted into the gap between the sailor suit-like portion 32 and the pipe portion 33. The film F is folded into the tubular shape via the gap between the sailor suit-like portion 32 and the pipe portion 33. The tubular film F is conveyed downward along the outer peripheral surface of the pipe portion 33.

The film clamp 34 is disposed on an upstream end of the sailor suit-like portion 32. The film clamp 34 includes a fixed bar 35, a movable bar 36, and an air cylinder 37.

The fixed bar 35 and the movable bar 36 are disposed separately in parallel along the lateral direction on the slightly upstream side with respect to the sailor suit-like portion 32. The fixed bar 35 is disposed in a rear direction, while the movable bar 36 in a front direction.

The film F is inserted between the fixed bar 35 and the movable bar 36. The fixed bar 35 is fixed slightly separately from the inner surface of the film F. The movable bar 36 is coupled to the air cylinder 37 slightly separately from the outer surface of the film F.

The air cylinder 37 presses the movable bar 36 so as to bring it into close contact with the fixed bar 35 or detaches it from the fixed bar 35.

The film clamp 34 can sandwich the film F by the fixed bar 35 and the movable bar 36 by driving the air cylinder 37.

The support frame 38 is a member which supports only the bag-making guide 31 and the film clamp 34. The support frame 38 is formed having a cuboid shape.

The support frame 38 is independently provided separately from the apparatus frame 2. The support frame 38 is disposed above (upstream side of) the bag-making/filling/packaging portion 6. The support frame 38 is supported by the apparatus frame 2 through the weighing portion 40.

A lower end of the sailor suit-like portion 32 and an upper end of the pipe portion 33 are connected to the support frame 38. The pipe portion 33 extends below the support frame 38.

<Weighing Portion 40>

The weighing portion 40 is for measuring a weight change of the bag-making guide unit 30 and includes a pair of load cells 41. The load cells 41 are fixed to the apparatus frame 2 and support the support frame 38.

The load cells 41 are disposed on outer sides (left side, right side) in the lateral direction of the bag-making/filling/packaging portion 6, respectively. The support frame 38 is disposed (placed) across the pair of load cells 41.

Since the weighing portion 40 supports the support frame 38, the weight change of the film F suspended from the bag-making guide 31 can be measured. That is, the weighing portion 40 weighs (weight measurement) the content X loaded into the tubular film F.

<Film Conveying Portion 50>

The film conveying portion 50 intermittently conveys the film F downward at a predetermined pitch. The film conveying portion 50 is disposed on both side surfaces of the pipe portion 33 below the sailor suit-like portion 32.

The film conveying portion 50 includes two rotating belts 51 which feed the film F downward. The rotating belts 51 are disposed on the both side surfaces (in left-right direction) of the pipe portion 33, respectively, and extend in the vertical direction. The two rotating belts 51 are coupled to the apparatus frame 2 through a rotating belt driving portion (not shown).

The rotating belts 51 are moved inward in the lateral direction (get closer to each other) and are brought into close contact with the pipe portion 33. As a result, the film F is sandwiched by the rotating belts 51 and the pipe portion 33. The film conveying portion 50 intermittently rotates the two rotating belts 51 and conveys the film F downward. The conveyed amount (1 pitch) of the film F by the film conveying portion 50 matches a length of the film packaging bag Gin the vertical direction.

The rotating belts 51 can be moved outward in the lateral direction (separated from each other) so as to be detached from the pipe portion 33 and the film F.

<Vertical Sealing Portion 60>

The vertical sealing portion 60 is disposed on a front surface of the pipe portion 33 below the sailor suit-like portion 32. The vertical sealing portion 60 thermally seals (heat-fuses) the side edges of the film F each other along the vertical direction, the film F having been folded into the tubular shape via the sailor suit-like portion 32. The vertical sealing portion 60 includes a vertical heater 61 and the guide roller pairs 62, 63.

The vertical heater 61 is composed of a pair of heater bars extending in the vertical direction and is coupled to the apparatus frame 2 through a vertical heater bar driving portion (not shown).

When the vertical heater 61 thermally seals the side edges of the film F to each other along the vertical direction, a vertical seal T (see FIG. 1) is formed in the film F, and the film F becomes a complete tubular shape.

The vertical seal T is also called a back-seal. A length of the vertical heater 61 (vertical seal T) matches the length of the film packaging bag G in the vertical direction.

When the vertical heater 61 (the pair of heater bars) thermally seals the film F, it is moved inward in the lateral direction and sandwiches the film F. When the vertical heater 61 (the pair of heater bars) does not thermally seal the film F, it moves outward in the lateral direction so as to be detached from the film F.

The guide roller pairs 62, 63 are composed of a pair of driven rollers, respectively, and sandwiches the side edges of the film F in the overlapped state. The guide roller pairs 62, 63 sandwich the side edges of the film F at all times.

The guide roller pair 62 is disposed immediately above the vertical heater 61, and the guide roller pair 63 is disposed immediately below the vertical heater 61. The guide roller pair 62 sandwiches both of the side edges of the film F immediately before thermal sealing by the two driven rollers. The guide roller pair 63 sandwiches the both side edges (vertical seal T) of the film F immediately after the thermal sealing by the two driven rollers.

The guide roller pairs 62, 63 are fixed rotatably with respect to a roller support frame 65 coupled to the support frame 38. The roller support frame 65 is formed having a rectangular shape and is disposed on the front surface of the pipe portion 33. The roller support frame 65 extends downward from the bottom surface of the support frame 38 and surrounds the vertical heater 61.

That is, the guide roller pairs 62, 63 are coupled to the support frame 38, unlike the vertical heater 61.

[Filling/Packaging Portion 8]

The filling/packaging portion 8 fills the content X inside the tubular film F and further manufactures the film packaging bag G in which the content X is filled. The filling/packaging portion 8 includes a filling portion 70, a lateral sealing portion 80, a square-bottom sealing portion 90, a bag supporting portion 100 and the like.

<Filling Portion 70>

The filling portion 70 loads (fills) the content X in a liquid or paste state inside the tubular film F. The filling portion 70 includes a nozzle 71, a shutter 72, and a liquid-feeding pump (not shown).

The nozzle 71 is disposed along a center axis of the pipe portion 33. The nozzle 71 is inserted into the pipe portion 33 and extends downward. The nozzle 71 protrudes upward with respect to the pipe portion 33 and is fixed to the apparatus frame 2. The nozzle 71 discharges drinking water, for example, to the downward direction.

The shutter 72 is built in the lower end (distal end) of the nozzle 71 and adjusts an opening degree of the nozzle 71. That is, the shutter 72 adjusts the discharge amount of the content X.

The liquid-feeding pump transports the content X toward an upper part of the nozzle 71.

<Lateral Sealing Portion 80>

The lateral sealing portion 80 is disposed below the lower end of the nozzle 71. The lateral sealing portion 80 thermally seals (heat-fuses) the tubular film F across the lateral direction and forms the film packaging bag G. The lateral sealing portion 80 includes a flattening molding portion 81, a lateral heater 84, a wrinkle removing portion 87, and a deaerating plate 88.

The flattening molding portion 81 flattens (makes flat) the tubular film F in the lateral direction. The flattening molding portion 81 includes a pair of guide rods 82 and an air cylinder 83 which swings the guide rods 82 in the lateral direction.

The guide rods (second guide rods) 82 are rod bodies further extending downward from the lower ends of the both side surfaces (left face and right face) of the pipe portion 33. The lower end (distal end) of the guide rod 82 is located below the lower end of the nozzle 71 and is disposed outside in the lateral direction so as to be capable of swing.

The air cylinder (second-guide-rod driving portion) 83 presses the upper end of the guide rod 82 and swings the guide rod 82 outward in the lateral direction.

The flattening molding portion 81 can swing the lower ends of the pair of guide rods 82 outward in the lateral direction so as to expand the tubular film F from the inside to outside in the lateral direction and flatten it.

The lateral heater 84 extends in the lateral direction immediately below the nozzle 71 and the guide rods 82. The lateral heater 84 is composed of a pair of heater bars 85, 86 disposed with film F therebetween. The lateral heater 84 is coupled to the apparatus frame 2 through the lateral heater bar driving portion (not shown).

When the lateral heater 84 thermally seals the tubular film F across the lateral direction, a lateral seal Y is formed in the film F. Moreover, the tubular film F becomes the film packaging bag G.

When the pair of heater bars 85, 86 thermally seals the film F, they move inward in the front-back direction (getting closer to each other) and sandwiches the film F. When the pair of heater bars 85, 86 does not thermally seal the film F, it moves outward in the front-back direction (separated from each other) so as to be detached from the film F.

A cutter 89 for cutting the lateral seal Y across the lateral direction (bisecting the lateral seal Y to up-down parts for forming lateral seals Y1, Y2) is provided on the heater bar 85.

An air blow (not shown) for cooling the lateral seal Y of the film packing bag G is provided below the lateral heater 84.

The wrinkle removing portion 87 extends in the lateral direction immediately below the lateral heater 84. The wrinkle removing portion 87 is composed of a pair of two sets (four) clamp bars disposed outside in the lateral direction with the film F (film packaging bag G) therebetween. The wrinkle removing portion 87 is coupled to the apparatus frame 2 through a wrinkle removing plate driving portion (not shown).

The wrinkle removing portion 87 grasps both ends of the film F in the left-right direction, respectively, before the lateral heater 84 thermally seals the film F.

When the lateral heater 84 thermally seals the film F, since the wrinkle removing portion 87 grasps the outer sides of the film F in the lateral direction, a wrinkle hardly occurs in the lateral seal Y.

When the wrinkle removing portion 87 (pair of clamp bars) grasps the film F, it moves inward in the front-back direction so as to sandwich the film F. When the wrinkle removing portion 87 (pair of clamp bars) does not grasp the film F, it moves outward in the front-back direction so as to be detached from the film F.

The deaerating plate 88 extends in the lateral direction immediately below the wrinkle removing portion 87. The deaerating plate 88 is composed of a pair of flat plates disposed with the film F (film packaging bag G) therebetween. The deaerating plate 88 is coupled to the apparatus frame 2 through a deaerating plate driving portion (not shown).

The deaerating plate 88 presses the film F in the front-back direction before the lateral heater 84 thermally seals the film F. The deaerating plate 88 regulates the thickness of the film F (film packaging bag G). As a result, the content X filled in the film F is raised to immediately below the wrinkle removing portion 87. That is, the deaerating plate 88 pushes out air upward from the film F (film packaging bag G).

When the deaerating plate 88 (pair of flat plates) presses the film F, it moves inward in the front-back direction and gets close to each other with the film F therebetween. When the deaerating plate 88 (pair of flat plates) does not press the film F, it moves outward in the front-back direction so as to be detached from the film F.

<Square-Bottom Sealing Portion 90>

Figure 5:
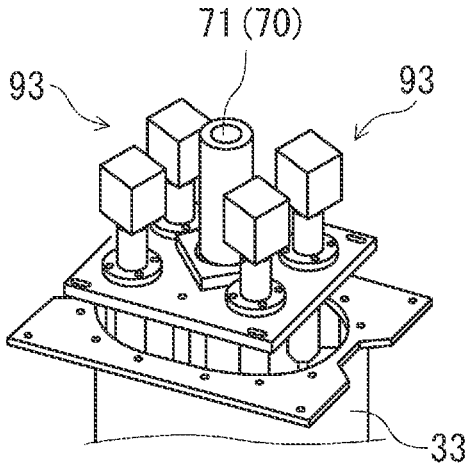
FIG. 5 are perspective views illustrating a square-bottom sealing portion 90, in which FIG. 5(*a*) illustrates an upper structure and FIG. 5(*b*) illustrates a lower structure.
Figure 5:
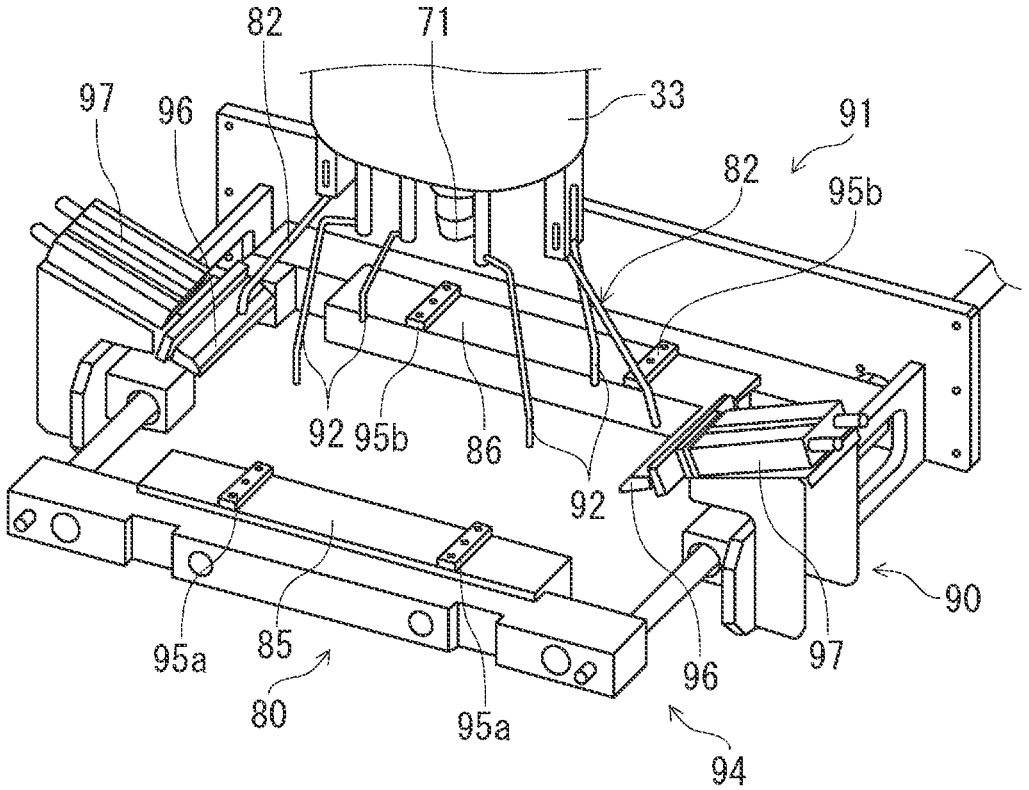

FIG. 5 are perspective views illustrating the square-bottom sealing portion 90, in which FIG. 5(*a*) illustrates an upper structure and FIG. 5(*b*) illustrates a lower structure.

The square-bottom sealing portion 90 is disposed immediately above the lateral sealing portion 80. The square-bottom sealing portion 90 folds the bottom part of the tubular film F into a square shape after the lateral seals Y were formed so as to form the pair of square-bottom seals K. That is, a square bottom surface is formed on the film packaging bag G.

The square-bottom sealing portion 90 includes a square-bottom molding portion 91 and a square-bottom heater 94.

The square-bottom molding portion 91 expands the bottom part of the tubular film F from the inside to the outside in the four corner directions and folds it into a square.

The square-bottom molding portion 91 includes two sets of pairs (four pieces) of guide rods 92 and a guide-rod driving portion 93 for vertically moving, rotating, and swinging the guide rods 92.

The guide rods (first guide rods) 92 are rod bodies inserted into a pipe portion 33 and further extending in a downward direction from lower ends of both side surfaces (left face, right face) of the pipe portion 33. The guide rods 92 are disposed one each in the front-back direction of the two guide rods 82, respectively. The lower ends (distal ends) of the guide rods 92 are located more inside in the lateral direction than the lower ends of the guide rods 82.

In operation, the lower end of the guide rods 92 are located below the lower end of the guide rod 82 (proximate to heater bars 85, 86) and more outside in the front-back direction than the lower end of the guide rod 82 (operating position P).

In retreat, the lower ends of guide rods 92 are located at substantially the same height as that of the lower end of the guide rod 82 and more inside in the front-back direction than the lower end of the guide rod 82 (retreated position Q).

The guide-rod driving portion (first-guide-rod driving portion) 93 is composed of a plurality of air cylinders disposed above the pipe portion 33. This vertically moves the guide rod 92, rotates the guide rod 92 around a vertical shaft and swings the lower end of the guide rod 92 outward in the front-back direction (the outside in the four corner directions).

The square-bottom molding portion 91 expands the bottom part of the tubular film F from the inside to a rectangle (expands to a rectangle) by lowering and moving the lower ends of the two sets of pairs (four pieces) of guide rods 92 outward in the front-back direction (operating position P) by the guide-rod driving portion 93. That is, the bottom surface G4 appears on the film F (film packaging bag G).

The square-bottom molding portion 91 operates after the tubular film F is sandwiched by the heater bars 85, 86 of the lateral sealing portion 80. By expanding the bottom part of the film F from the inside to a rectangle in a state where the lower end of the film F is fixed by the heater bars 85, 86, the both corner parts of the bottom part of the film F are folded into a triangle. That is, the flap G5 appears on the film F (film packaging bag G).

The square-bottom molding portion 91 operates until the square bottom seal K is formed on the film F.

The guide-rod driving portion 93 causes the guide rod 92 to stand by at the retreated position Q until the film F is completely sandwiched by the heater bars 85, 86. The retreated position Q is a position where the guide rod 92 cannot contact the inner side of the film F (non-contactable).

The guide rod 92 is prevented from coming into contact with the inner side of the film F and inhibiting flattening of the film F by flattening molding portions 81 (a pair of guide rods 82). This is for preventing generation of wrinkles on the bottom part of the film F when the lateral seal Y is to be formed.

Once the square-bottom seal K is formed on the film F, the guide-rod driving portion 93 raises and moves the guide rod 92 to the retreated position Q.

The square-bottom heater 94 extends in the front-back direction on the upper surfaces of the heater bars 85, 86 of the lateral sealing portion 80. The square-bottom heater 94 is composed of two sets of pairs of heater bars 95, 96 and is disposed with the both corner parts on the bottom part of the film F obliquely sandwiched in the up-down direction. The pair of heater bars 95, 96 are disposed in parallel with each other.

The two heater bars 95 are divided into two parts in the front-back direction, respectively, and are disposed on the upper surfaces of the heater bars 85, 86. A heater bar 95*a* is disposed on the upper surface of the heater bar 85, and a heater bar 95*b* is disposed on the upper surface of the heater bar 86.

The two heater bars 96 are disposed obliquely upward on the outside (upward direction on the outside in the lateral direction) of the heater bar 95, respectively, and are coupled with the device frame 2 through a square-bottom heater-bar driving portion 97.

The square-bottom heater 94 is enabled to function when the heater bars 85, 86 are brought into close contact at the same time as when the two heater bars 95*a*, 95*b* are brought into close contact.

The square-bottom heater 94 brings the two heater bars 96 into close contact with the heater bars 95 by the square-bottom heater-bar driving portion 97 after the square-bottom molding portion 91 folds the film F bottom part. Then, the heater bars 95, 96 thermally seal the both corner parts on the bottom part (bottom side part of a portion folded into a triangle) of the film F (film packaging bag G) over the front-back direction so as to form the square bottom seal K on the film packaging bag G. As a result, the bottom part of the film packaging bag G becomes the square bottom surface G4, and the flap G5 is sealed.

Once the square-bottom seal K is formed on the film F, the square-bottom heater 94 detaches the heater bars 96 from the heater bars 95 by the square-bottom heater-bar driving portion 97.

<Bag Supporting Portion 100>

The bag supporting portion 100 is disposed immediately below the deaerating plate 88. The bag supporting portion 100 supports the bottom of the film packaging bag G when the film packaging bag G formed on the lower end of the film F is separated. The bag supporting portion 100 cuts the film packaging bag G off from the film F to slide it down toward a cardboard box B disposed immediately below.

The bag supporting portion 100 is coupled to the apparatus frame 2 through the bag supporting driving portion (not shown).

The bag supporting portion 100 is composed of a pair of two sets (four) of roller conveyors 101, 102 and is disposed so as to surround the film F (film packaging bag G) in the front-back and left-right directions.

The roller conveyors 101, 102 are a plurality of driven rollers disposed in parallel and in a flat-plate state. The pair of roller conveyors 101 is disposed in the front-back direction with the film F therebetween. The pair of roller conveyors 102 is disposed in the right-and-left direction with the film F therebetween.

The roller conveyors 101, 102 are capable of swing up-down and take a substantially horizontal attitude or a substantially perpendicular attitude.

When the roller conveyor pair 101 is swung so that the lower ends get closer to each other, it forms a shallow V-shape when seen from the side. As a result, the roller conveyor pair 101 supports the bottom of the film packaging bag G.

When the roller conveyor pair 101 is swung so as to be orthogonal to each other, a space through which the film packaging bag G falls off is formed. As a result, the roller conveyor pair 101 slides the film packaging bag G downward.

The roller conveyor pair 102 is disposed with the roller conveyor pair 101 therebetween. When the roller conveyor pair 102 is swung so as to be horizontal, it forms a linear shape when seen from the front. As a result, the roller conveyor pair 102 supports the bottom of the film packaging bag G.

When the roller conveyor pair 102 is swung so as to be orthogonal to each other, a space through which the film packaging bag G falls off is formed. As a result, the roller conveyor pair 102 slides the film packaging bag G downward.

<Conveyor 110>

The conveyor (bag-body carrying-out portion) 110 is disposed immediately below the filling/packaging portion 8. The conveyor 110 is laid across a space between the leg portions 3 of the bag-making/filling/packaging portion 6 on an installation surface (floor surface) of the bag-making/filling/packaging portion 6.

The conveyor 110 is a plurality of driven rollers disposed in parallel and in a flat-plate state and conveys (carries in/carries out) the cardboard box B toward immediately below the filling/packaging portion 8.

The cardboard box (accommodating box) B is a box body accommodating the film packaging bag G, and a 0201 type (JIS Z 1507), for example, is used. The cardboard box B is carried in (disposed) immediately below the filling/packaging portion 8 in a state with an upper lid open (in a state where an outer flap and an inner flap are upright perpendicularly).

[Manufacturing Method of Film Packaging Bag G with Contents]

Subsequently, a step of manufacturing the film packaging bag G with contents by using the vertical bag-making/filling/packaging machine 1 will be described with reference to figures. For convenience of description, some parts of the apparatus are omitted in FIGS. 6 to 13.

The step of manufacturing the film packaging bag G with contents is performed in order of a film forming step S1, a vertical sealing step S2, a lateral sealing step S3, a square-bottom sealing step S4, a film conveying step S5, a film tension releasing step S6, a content filling/weighing step S7, a bag-body cutting-off step S8, and a boxing step S9.

These steps are performed in the following order: the film forming step S1, the vertical sealing step S2, the lateral sealing step S3, the square-bottom sealing step S4, the film conveying step S5, the film tension releasing step S6, the content filling/weighing step S7, the lateral sealing step S3, (the vertical sealing step S2, the square-bottom sealing step S4), the bag-body cutting-off step S8, and the boxing step S9.

Figure 6:
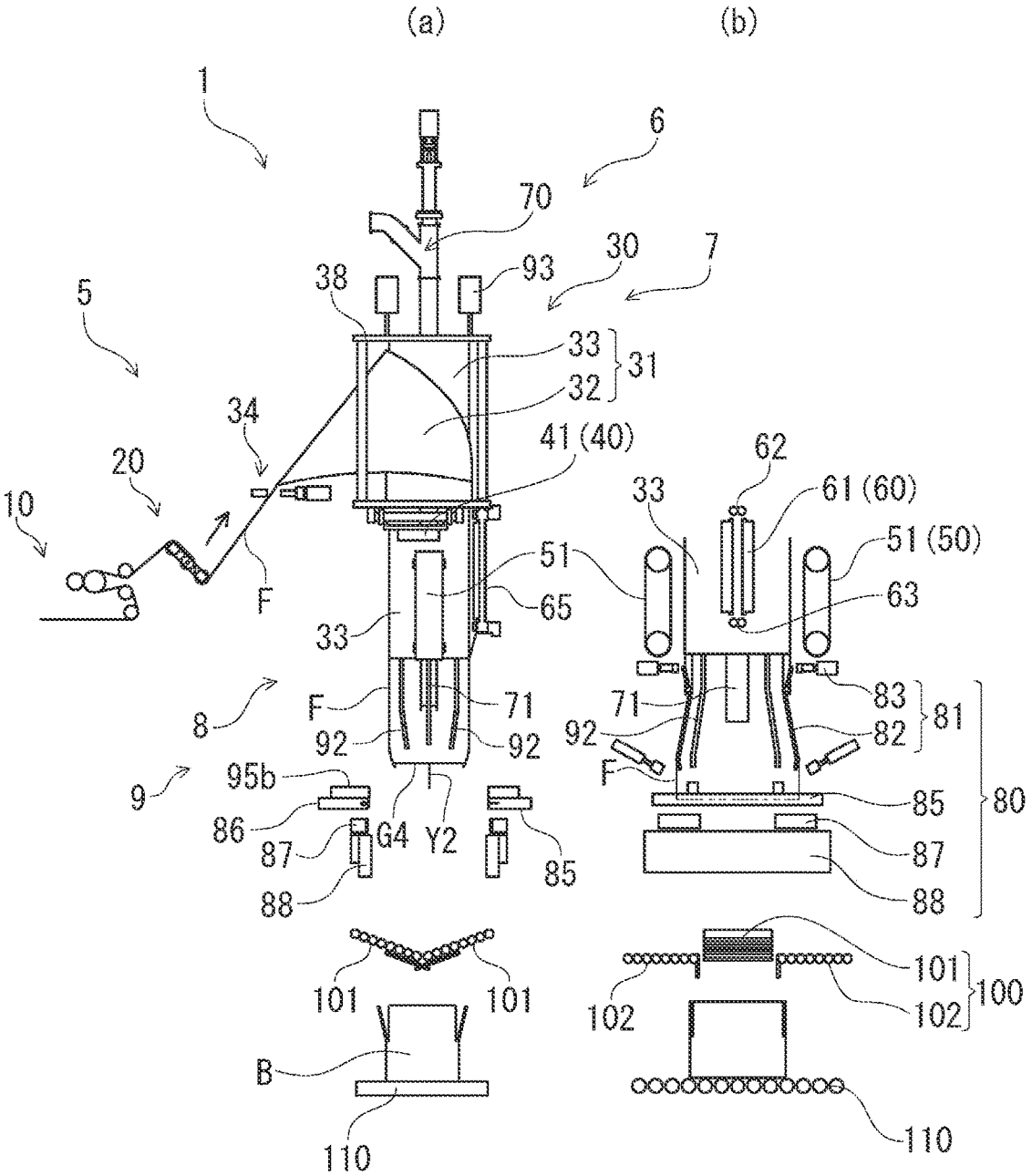
FIG. 6 are views illustrating a film forming step S1 and the like of a manufacturing method of a film packaging bag G with contents, in which FIG. 6(*a*) is a side view and FIG. 6(*b*) is a front view.

FIG. 6 are views illustrating a film forming process 51 and the like of the manufacturing method of the film packaging bag G with contents, in which FIG. 6(*a*) is a side view and FIG. 6(*b*) is a front view.

Specifically, the film forming process 51 to a square-bottom sealing process S4 are illustrated. The film F is folded into a tubular shape and made into a bag shape by sealing the lower end (distal end) of the film F. Moreover, the square bottom surface G4 (flap G5) is formed on the lower end of the film F.

(Film Engaging Step S1)

First, the film supplying portion 5 lets out the film F from the roll Fr (see FIG. 2). Then, the film F is folded into the tubular shape via the bag-making guide 31 and fed downward.

The film forming step S1 is continued at all times during the subsequent steps.

(Vertical Sealing Step S2)

Subsequently, the vertical sealing portion 60 thermally seals the side edges of the film F to each other so as to make the film F into a complete tubular shape. The vertical seal T is formed on the film F. Then, the vertical sealing portion 60 is detached from the film F. Then, the film F is further fed downward.

(Lateral Sealing Step S3)

Subsequently, as illustrated in FIGS. 6, the film F is thermally sealed in the lateral direction by the lateral sealing portion 80, and the lower end is sealed. That is, the lateral seal Y is formed on the film F and the film F becomes the bag body.

The lateral sealing step S3 will be described in detail below.

(Square-Bottom Sealing Process S4)

Subsequently, the bottom part of the film F (bag body) is folded flat by the square-bottom sealing portion 90 and moreover thermally sealed in the front-back direction (pair of the square-bottom seals K are formed). The film F becomes the bottom surface G4 with a square bottom part and the triangular flap G5.

Once the lateral seal Y and the square-bottom seal K are formed, the lateral sealing portion 80 and the square-bottom sealing portion 90 are detached from the film F.

The square-bottom sealing process S4 will be described in detail below.

<Film Conveying Step S5>

Figure 7:
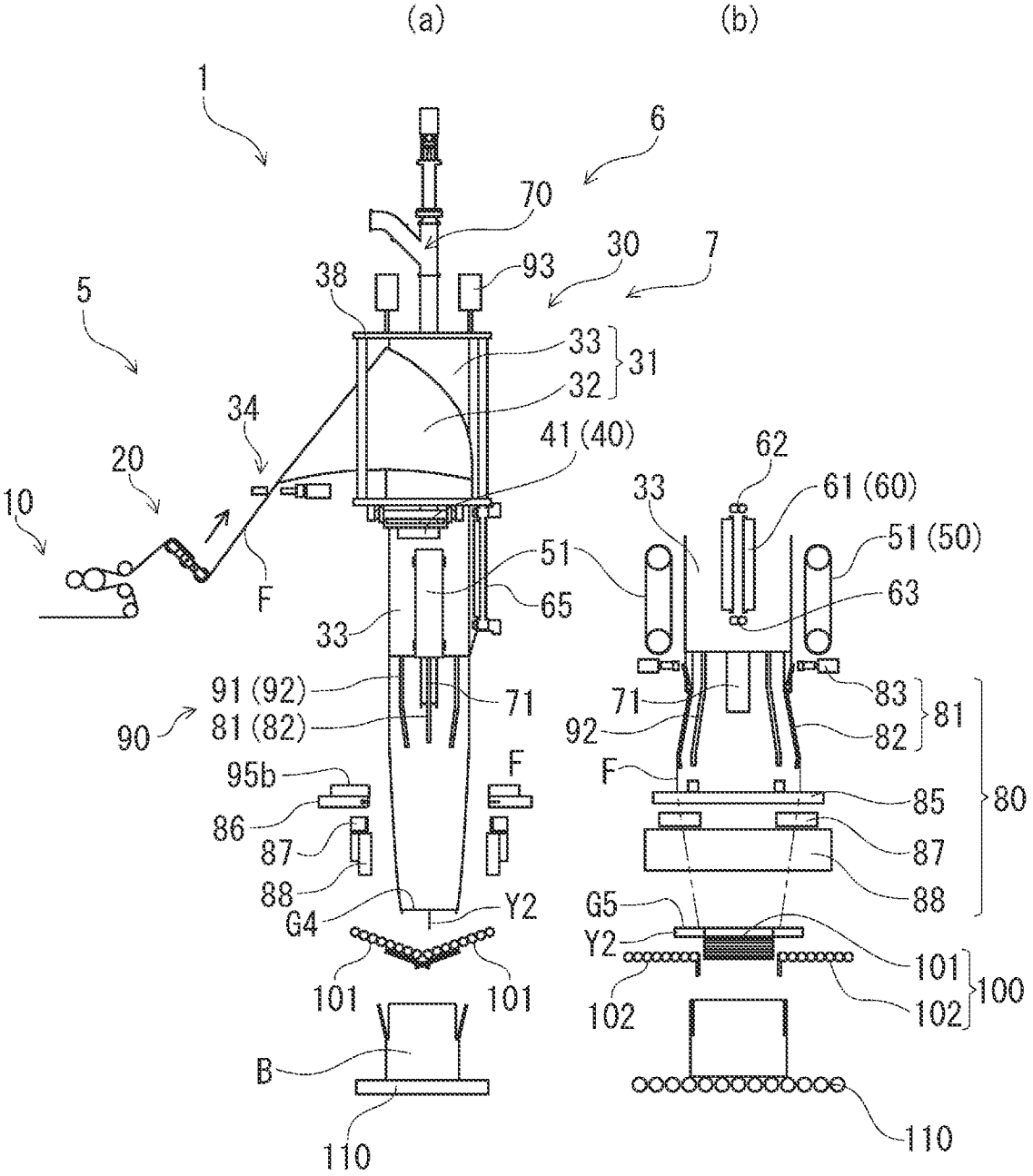
FIG. 7 are views illustrating a film conveying step S5 of the manufacturing method of the film packaging bag G with contents, in which FIG. 7(*a*) is a side view and FIG. 7(*b*) is a front view.

FIG. 7 are views illustrating the film conveying step S5 of the manufacturing method of the film packaging bag G with contents, in which FIG. 7(*a*) is a side view and FIG. 7(*b*) is a front view.

The film conveying step S5 conveys the film F to a predetermined position in preparation for the supply of the content X into the interior of the film F (bag body).

As illustrated in FIGS. 7, the film conveying portion 50 feeds out the film F downward by intermittently rotating the two rotating belts 51. At the same time, the conveying roller pair 10 is supportively operated. The conveying roller pair 10 rotates/drives the driving roller 11 by the driving motor 13 and lets out the film F from the roll Fr. When the film F is conveyed, a tension (tensile force) is generated in the film F.

As illustrated in FIGS. 7, in the bag-making/filling/packaging portion 6, the film F is fed out downward with a length of 1 pitch. The 1 pitch is a length of the film packaging bag G in the vertical direction.

<Film Tension Releasing Step S6>

Figure 8:
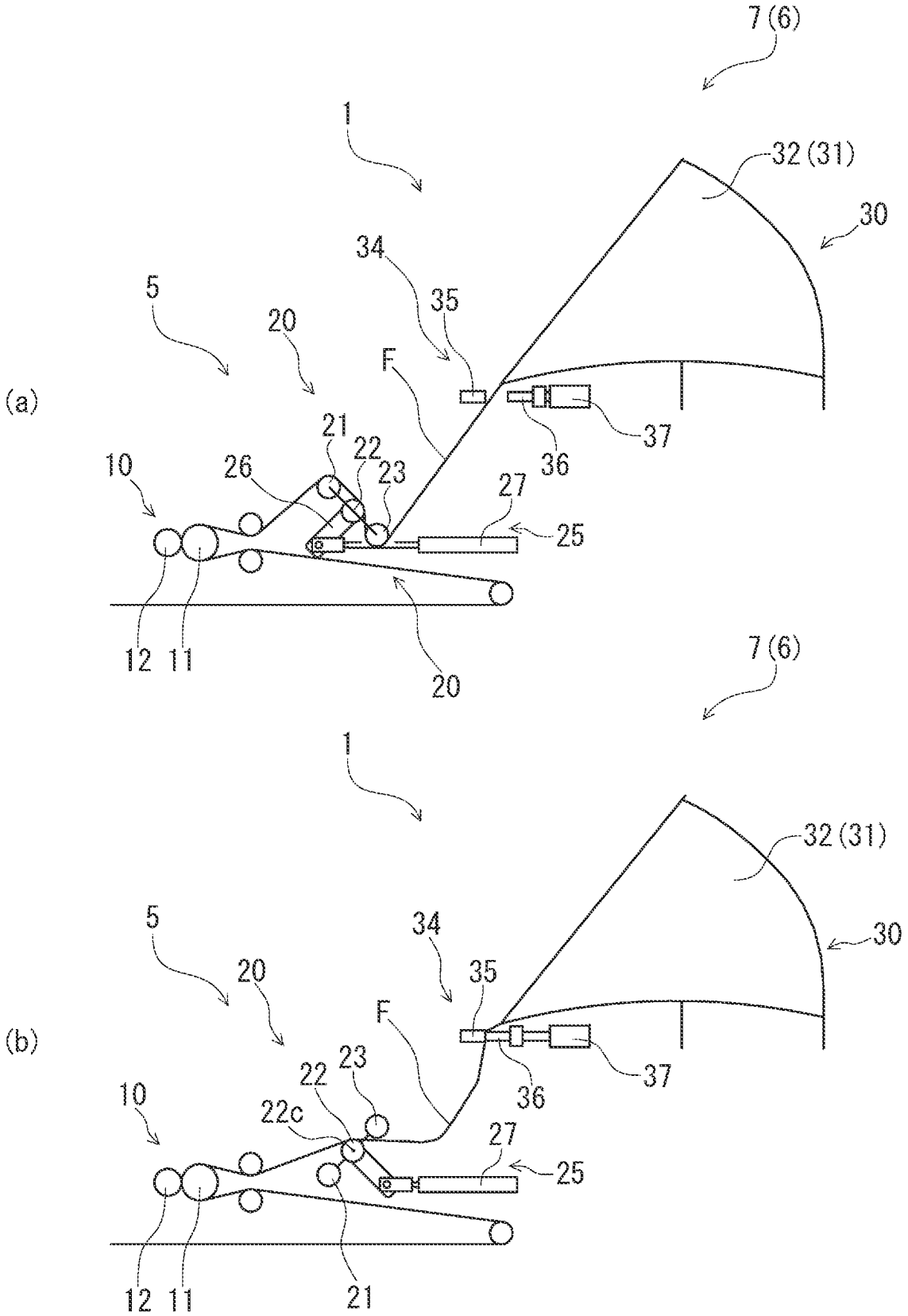
FIG. 8 are partially-enlarged side views illustrating the film tension releasing step S6 of the manufacturing method of the film packaging bag G with contents, in which FIG. 8(*a*) illustrates a state before tension release and FIG. 8(*b*) illustrates a state after the tension release.

FIG. 8 are partially-enlarged side views illustrating the film tension releasing step S6 of the manufacturing method of the film packaging bag G with contents, in which FIG. 8(*a*) illustrates a state before tension release and FIG. 8(*b*) illustrates a state after the tension release.

The film tension releasing step S6 is performed prior to the supply of the content X into the interior of the film F immediately after the film conveying step S5 is completed.

The film tension releasing step S6 has a film clamping step S6A, a film loosening step S6B, and a rotating belt retreating step S6C.

(Film Clamping Step S6A)

In the film clamping step S6A, the tubular film F suspended from the bag-making guide 31 is held so as not to move downward.

As illustrated in FIGS. 8, the film clamp 34 moves the movable bar 36 toward the fixed bar 35 by the air cylinder 37 so as to grasp the film F. As a result, movement of the film F is regulated.

Since the film clamp 34 is fixed to the sailor suit-like portion 32, the film F is held on the bag-making guide 31 in the suspended state.

(Film Loosening Step S6B)

In the film loosening step S6B, the tension applied to the film F is released. When the film F is let out from the roll Fr and conveyed to the filling/packaging portion 8 (web-conveyance), the tension is applied to the film F. This tension of the film F gives a bad influence to weighing of the content X by the weighing portion 40. When the tension of the film F acts on the load cell 41, the weighing (weight measurement) of the content X becomes unstable, and a measurement error occurs. Thus, the weighing of the content X and thus, quantitativity of the content X is lost.

Thus, the film tension releasing portion 20 releases the tension of the film F. Specifically, the tension of the film F laid between the film supplying portion 5 and the bag-making/filling/packaging portion 6 is released (loosened).

As a result, occurrence of the measurement error in the load cell 41 is prevented so that the weighing of the content X is performed accurately.

As illustrated in FIGS. 8, the film tension releasing portion 20 moves the driven rollers 21, 23 by the roller moving portion 25. The air cylinder 27 presses the supporting member 26 and rotates (revolves) the driven rollers 21, 23 around the rotating shaft 22*c*.

When the driven rollers 21, 23 are rotated around the rotating shaft 22*c*, the driven rollers 21, 23 are detached from the film F. As a result, the film F laid over the film tension releasing portion 20 is loosened, and the tension is released.

On the other hand, the conveying roller pair 10 holds the film F at all times. Thus, even if the film tension releasing portion 20 is operated, and the tension of the film F is released, the tension of the film F in the film supplying portion 5 is maintained. The film F is not loosened, but the tension is maintained from the roll Fr to the conveying roller pair 10. That is, the tension of film F is released only between the conveying roller pair 10 and the sailor suit-like portion 32.

Since the conveying roller pair 10 maintains the tension of the film F, occurrence of a wrinkle or meandering in the film F can be avoided when the film conveyance (intermittent conveyance) is resumed. Thus, the film conveyance (intermittent conveyance) can be resumed smoothly.

(Rotating Belt Retreating Step S6C)

In the rotating belt retreating step S6C, the rotating belt 51 is moved outward in the lateral direction so as to be detached from the pipe portion 33 (film F).

When the rotating belt 51 is detached from the pipe portion 33, the bag-making guide unit 30 is separated from the apparatus frame 2. That is, the bag-making guide unit 30 is supported by (placed on) the apparatus frame 2 only through the weighing portion 40.

When the content X is weighed, if the rotating belt 51 is in contact with the bag-making guide unit 30 or the film F, it gives a bad influence to the weighing of the content X by the weighing portion 40 (a measurement error occurs). Thus, as illustrated in FIGS. 8, the rotating belt 51 is moved, and the bag-making guide unit 30 is separated from the apparatus frame 2.

On the other hand, the guide roller pairs 62, 63 sandwich the side edges of the film F at all times. However, the guide roller pairs 62, 63 are fixed not to the apparatus frame 2 but to the support frame 38 through the roller support frame 65. Thus, even if the guide roller pairs 62, 63 sandwich the side edges of the film F, a bad influence is not given to the weighing of the content X by the weighing portion 40.

<Content Filling/Weighing Step S7>

Figure 9:
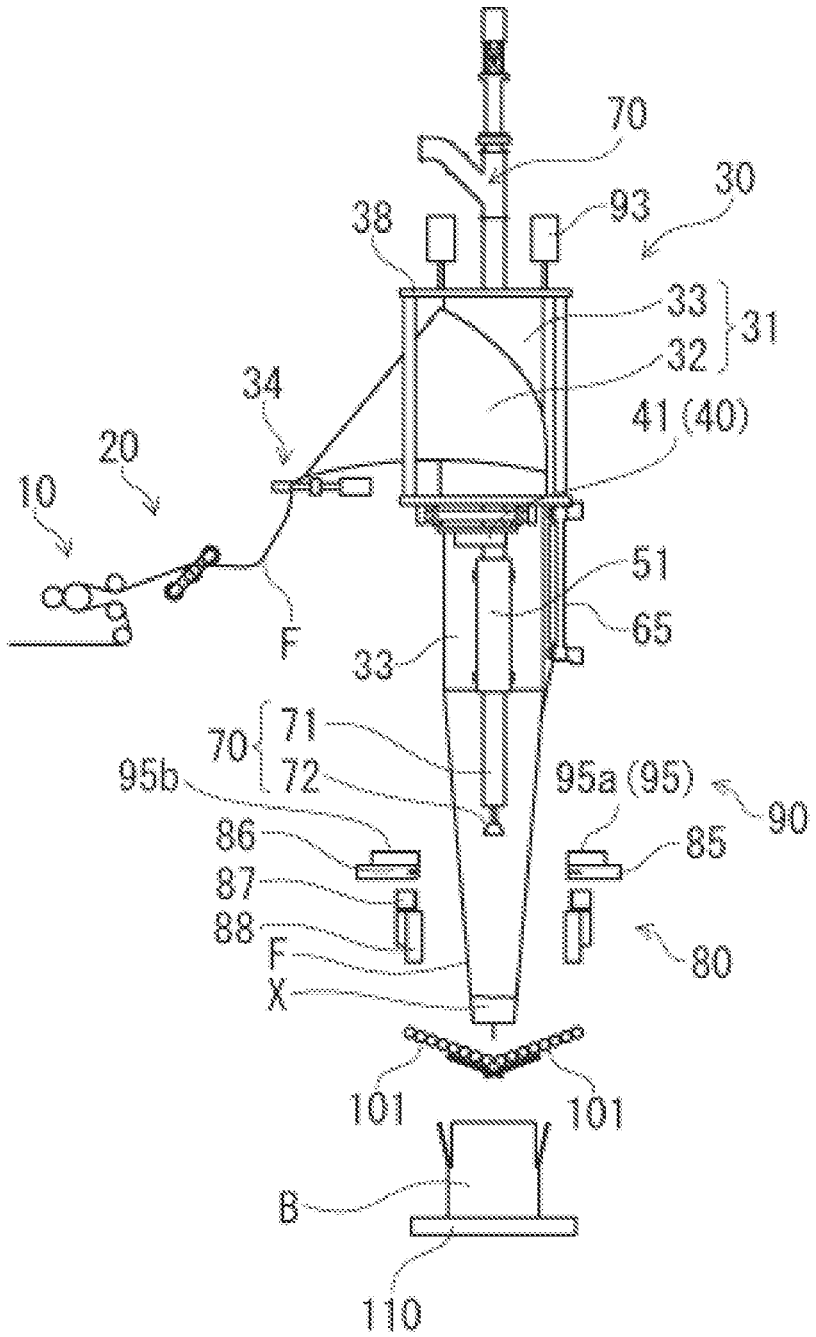
FIG. 9 is a side view illustrating a content filling/weighing step S7 of the manufacturing method of the film packaging bag G with contents.

FIG. 9 is a side view illustrating the content filling/weighing step S7 of the manufacturing method of the film packaging bag G with contents.

The content filling/weighing step S7 is a step in which the content X is loaded into the interior of the tubular film F and the content X is measured (weight measurement) at the same time. That is, the filling step and the weighing step of the content X are performed at the same time.

First, the weighing portion 40 resets the load cell 41 to zero.

Then, as illustrated in FIG. 9, the filling portion 70 releases the shutter 72 and further drives the liquid-feeding pump so as to discharge (supply) the content X from the nozzle 71. The weighing portion 40 starts weight measurement of the content X filled in the tubular film F by the two load cells 41. The weighing portion 40 outputs a measurement result of the content X to the control portion on a real time basis.

When the weight of the content X gets close to the target weight (target value), the filling portion 70 reduces a flow-rate of the liquid-feeding pump and decreases the opening degree of the shutter 72 (suppresses the loaded amount). Then, when the weight of the content X reaches the target weight, the filling portion 70 stops the liquid-feeding pump and closes the shutter 72.

Since the bag-making/filling/packaging portion 6 weighs the content X while loading the content X into the tubular film F, the weight of the content X (filled amount, loaded amount) can be made constant.

Moreover, when the content X is weighed, the bag-making guide unit 30 is supported by the apparatus frame 2 only through the weighing portion 40. Furthermore, the tension of the film F laid between the film supplying portion 5 and the bag-making/filling/packaging portion 6 is released. That is, the film F is in a state substantially supported only by the bag-making guide unit 30.

Therefore, the weighing portion 40 can accurately measure the weight of the content X filled in the tubular film F. Thus, quantitativity of the content X is improved.

<Lateral Sealing Step S3>

Figure 10:
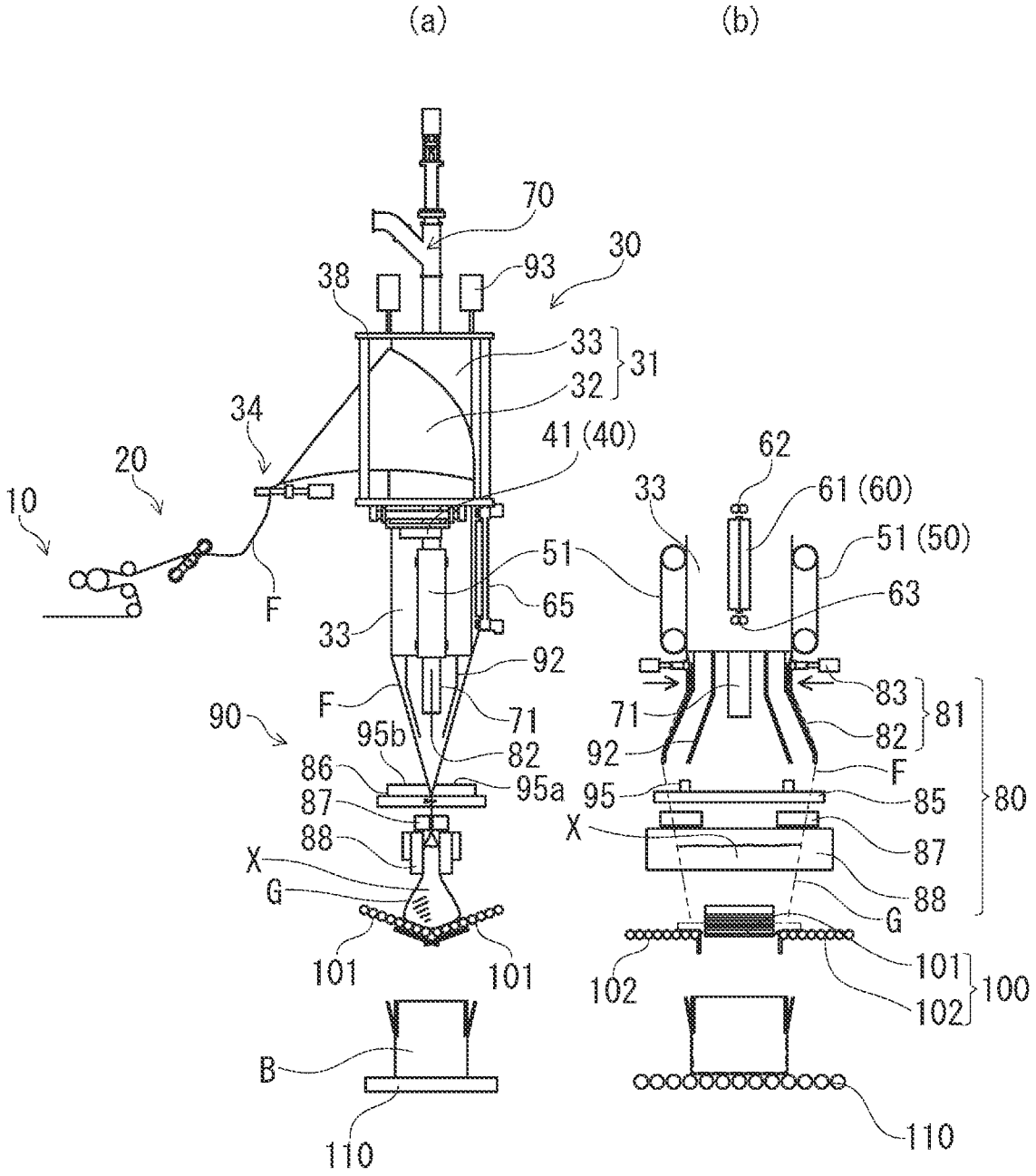
FIG. 10 are views illustrating a lateral sealing step S3 of the manufacturing method of the film packaging bag G with contents, in which FIG. 10(*a*) is a side view and FIG. 10(*b*) is a front view.

FIG. 10 are views illustrating the lateral sealing step S3 of the manufacturing method of the film packaging bag G with contents, in which FIG. 10(*a*) is a side view and FIG. 10(*b*) is a front view.

The lateral sealing step S3 is a step in which the tubular film F is thermally sealed across the lateral direction so as to seal the upper end of the film packaging bag G. The lateral sealing step S3 is also a step in which the lower end of the subsequent film packaging bag G is sealed (lateral sealing step S3 described above).

First, as illustrated in FIG. 10(*b*), the rotating belt 51 is pressed onto the pipe portion 33, and the film F is sandwiched. At this time, the rotating belt 51 is not rotated but holds the film F.

Then, as illustrated in FIG. 10(*b*), the flattening molding portion 81 expands the film F in the lateral direction and flatten it. The air cylinder 83 presses the guide rod 82 so as to swing the guide rod 82 outward in the lateral direction. A part of the tubular film F (a part upward from the film packaging bag G) is extended in the lateral direction and flattened by pressing the inner surface of the film F by the pair of guide rods 82 outward in the lateral direction.

Subsequently, as illustrated in FIG. 10(*a*), the deaerating plate 88 is moved inward in the front-back direction and presses the content X filled in the film F. As a result, the upper end side of the film packaging bag G is flattened, and the content X is pushed up to immediately below the lateral heater 84.

Subsequently, as illustrated in FIG. 10(*a*), the wrinkle removing portion 87 is moved inward in the front-back direction and grasps the outer side of the film F in the lateral direction. As a result, extension/contraction of the film F in the lateral direction becomes difficult.

Moreover, as illustrated in FIG. 10(*a*), the lateral heater 84 is moved inward in the lateral direction and sandwiches the film F across the lateral direction. As a result, the lateral seal Y is formed in the film F, and the film packaging bag G with the content X is formed (manufactured).

(Vertical Sealing Step S2: Manufacturing Step of Subsequent Film Packaging Bag G)

At the same time as the formation of the lateral seal Y, the vertical sealing step S2 described above is performed. The vertical heater 61 is moved inward in the lateral direction and sandwiches both of the side edges of the film F. As a result, the vertical seal T is formed in the film F.

(Square-Bottom Sealing Process S4: Manufacturing Process of Subsequent Film Packaging Bag G)

Figure 11:
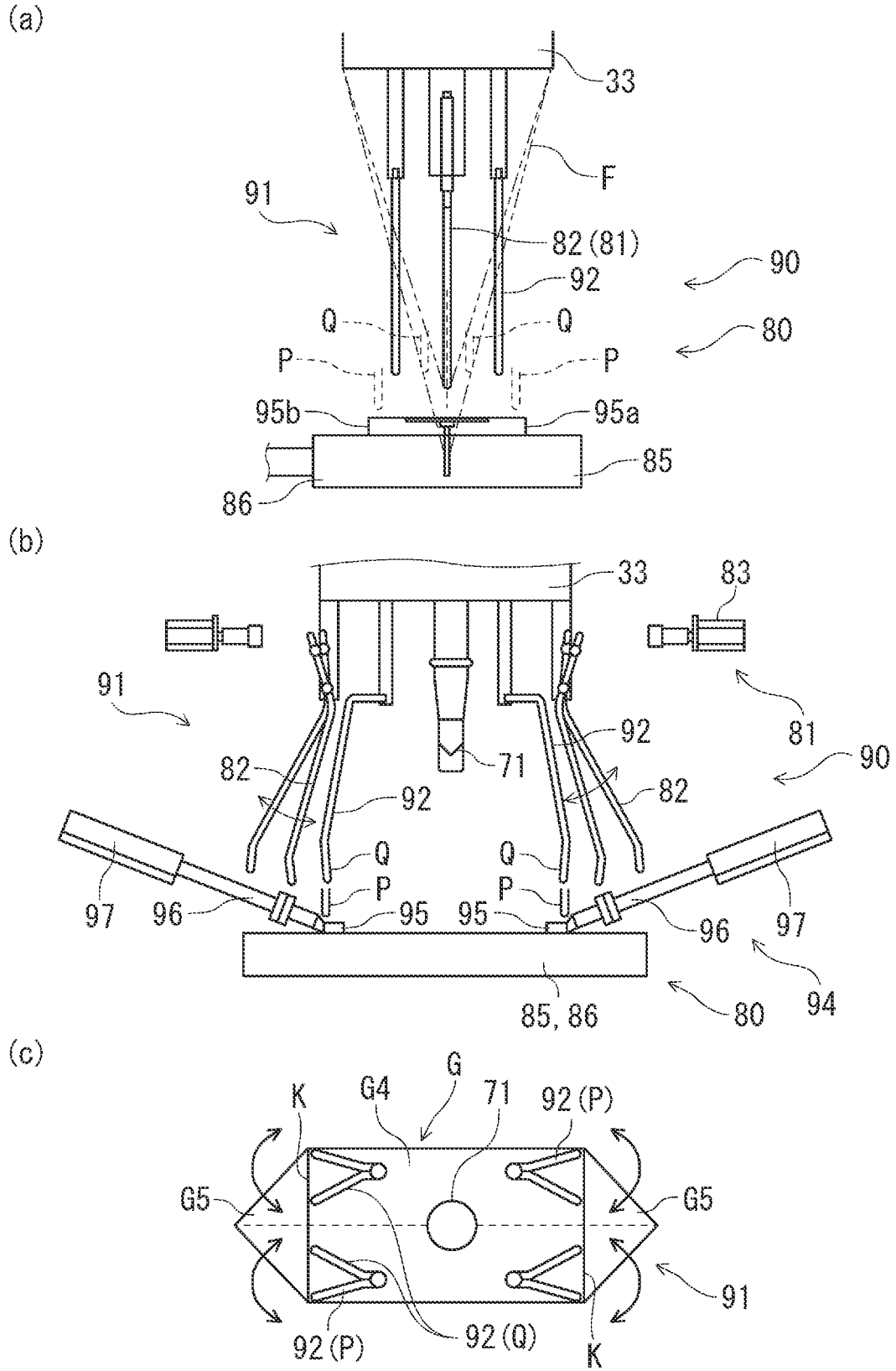
FIG. 11 are partially-enlarged views illustrating a square-bottom sealing step S4, in which FIG. 11(*a*) is a side view, FIG. 11(*b*) is a front view, and FIG. 11(*c*) is a plan view.

FIG. 11 are partially-enlarged views illustrating the square-bottom sealing process S4 of the manufacturing method of the film packaging bag G with contents, in which FIG. 11(*a*) is a side view, FIG. 11(*b*) is a front view, and FIG. 11(*c*) is a plan view.

For convenience of description, FIG. 11 illustrate the four guide rods 92 in operation (at the operating position P) and in retreat (at the retreated position Q).

At the same time as the formation of the lateral seal Y, the square-bottom sealing process S4 described above is performed.

The square-bottom sealing process S4 is a process in which the bottom part of the film F (bag body) is folded flat and moreover, the both corner parts of the film F are thermally sealed over the front-back direction so as to form the square bottom surface G4.

The square-bottom sealing process S4 is started when the lower end of the film F is expanded in the lateral direction and held in a flat state. The square-bottom sealing process S4 is started immediately after the lateral heat heater 84 sandwiches the film F.

Once the lateral heat heater 84 sandwiches the film F, two heater bars 95*a*, 95*b* disposed on the upper surfaces of the heater bars 85, 86 are brought into close contact with the film F between them and are enabled to function as the heater bars 95, respectively.

First, the flattening molding portion 81 returns the two guide rods 82 inward in the lateral direction, and then the square-bottom molding portion 91 moves the four guide rods 92 from the retreated position Q to the operating position P. Specifically, the square-bottom molding portion 91 lowers the four guide rods 92 from the retreated position Q and brings them closer to the heater bars 85, 86 as shown in FIGS. 11(*a*) and 11(*b*). Moreover, as shown in FIGS. 11(*a*) and 11(*c*), the square-bottom molding portion 91 rotates the four guide rods 92 around the vertical shaft from the retreated position Q and swings the distal ends (lower ends) of the four guide rods 92 outward in the front-back direction. That is, the four guide rods 92 move so that the distal ends thereof are expanded in a direction in which they are detached from each other (operating position P).

When the square-bottom molding portion 91 operates the four guide rods 92, the film conveying portion 50 sends out the film F slightly in the downward direction. This film conveying amount corresponds to a length in the lateral direction of the flap G5 (height of the triangle (flap G5) with the square-bottom seal K as the bottom side).

As a result, as shown in FIG. 11(*c*), on the upper surfaces of the heater bars 85, 86, the bottom part of the film F (bag body) in the flat state is expanded from the inside, and the bottom part becomes a flat square (the bottom surface G4 appears). At the same time, the both corner parts on the bottom part of the film F are folded into triangles, respectively (the flap G5 appears).

Since the film conveying portion 50 sends out the film F slightly in the downward direction, the bottom part of the film F is folded into the bottom surface G4 and the flap G5 without generating wrinkles. The two flaps G5 are folded into triangles so as to extend across the heater bars 95, respectively.

Subsequently, the square-bottom heater 94 moves the two heater bars 96 from obliquely upward to the operating position. Specifically, as shown in FIG. 11(*b*), the square-bottom heater-bar driving portion 97 moves the heater bar 96 obliquely downward and presses it to the heater bar 95. As a result, the film F (boundary between the bottom surface G4 and the two flaps G5) is sandwiched by the pair of heater bars 95, 96. Then, when the heater bars 95, 96 form the pair of square-bottom seals K on the film F, the bottom surface G4 and the two flaps G5 are sealed. Since the pair of square-bottom seals K are formed on the upper surfaces of the heater bars 85, 86, they are connected (welded) to the lateral seal Y, respectively.

As described above, the square bottom surface G4 and the flap G5 are formed on the bottom part of the film F.

When the square-bottom seal K is formed on the film F, the square-bottom heater-bar driving portion 97 moves the heater bar 96 to the retreated position (raised obliquely). Moreover, the guide-rod driving portion 93 moves the four guide rods 92 to the retreated position Q.

<Bag-Body Cutting-Off Step S8>

Figure 12:
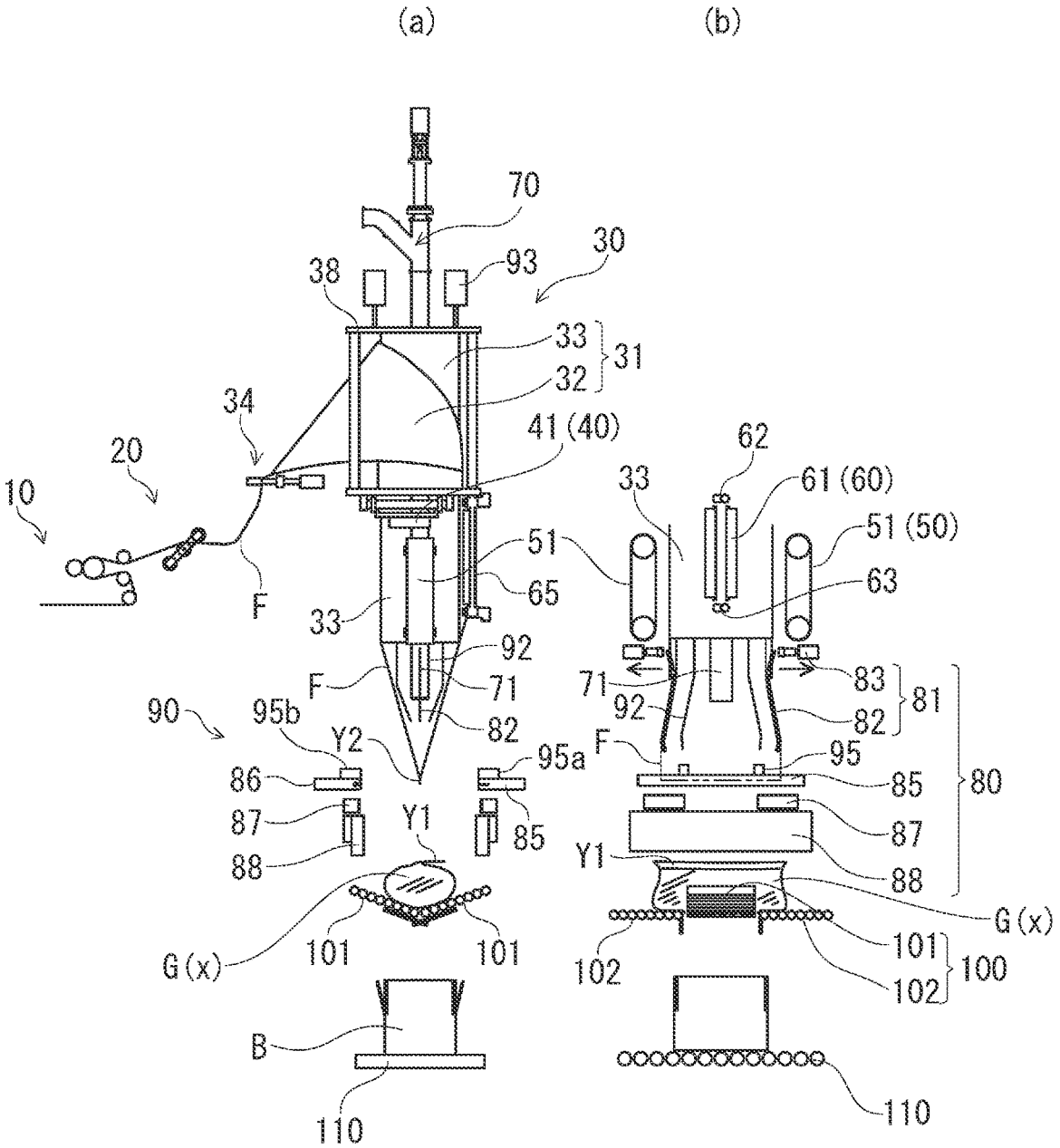
FIG. 12 are views illustrating a bag-body cutting-off step S8 of the manufacturing method of the film packaging bag G with contents, in which FIG. 12(*a*) is a side view and FIG. 12(*b*) is a front view.

FIG. 12 are views illustrating a bag-body cutting-off step S8 of the manufacturing method of the film packaging bag G with contents, in which FIG. 12(*a*) is a side view and FIG. 12(*b*) is a front view.

The bag-body cutting-off step S8 is a step of cutting off the film packaging bag G from the film F.

First, the lateral heater 84 cuts the lateral seal Y in the up-down direction (bisects the lateral seal Y into the lateral seals Y1, Y2) by a cutter 89 built in the heater bars 85. As a result, the film packaging bag G is cut off from the film F.

Then, the vertical heater 61 is moved outward in the lateral direction so as to be detached from the film F. Moreover, the wrinkle removing portion 87 and the deaerating plate 88 are moved outward in the front-back direction and are separated from the film F. Furthermore, the flattening molding portion 81 swings the guide rod 82 inward in the lateral direction by the air cylinder 83 so as to stop flattening of the film F.

As illustrated in FIGS. 12, the lateral heater 84 is moved outward in the front-back direction so as to be detached from the film F. As a result, the film packaging bag G is detached from the lateral heater 84 and is supported only by (placed on) the bag supporting portion 100.

<Boxing Step S9>

Figure 13:
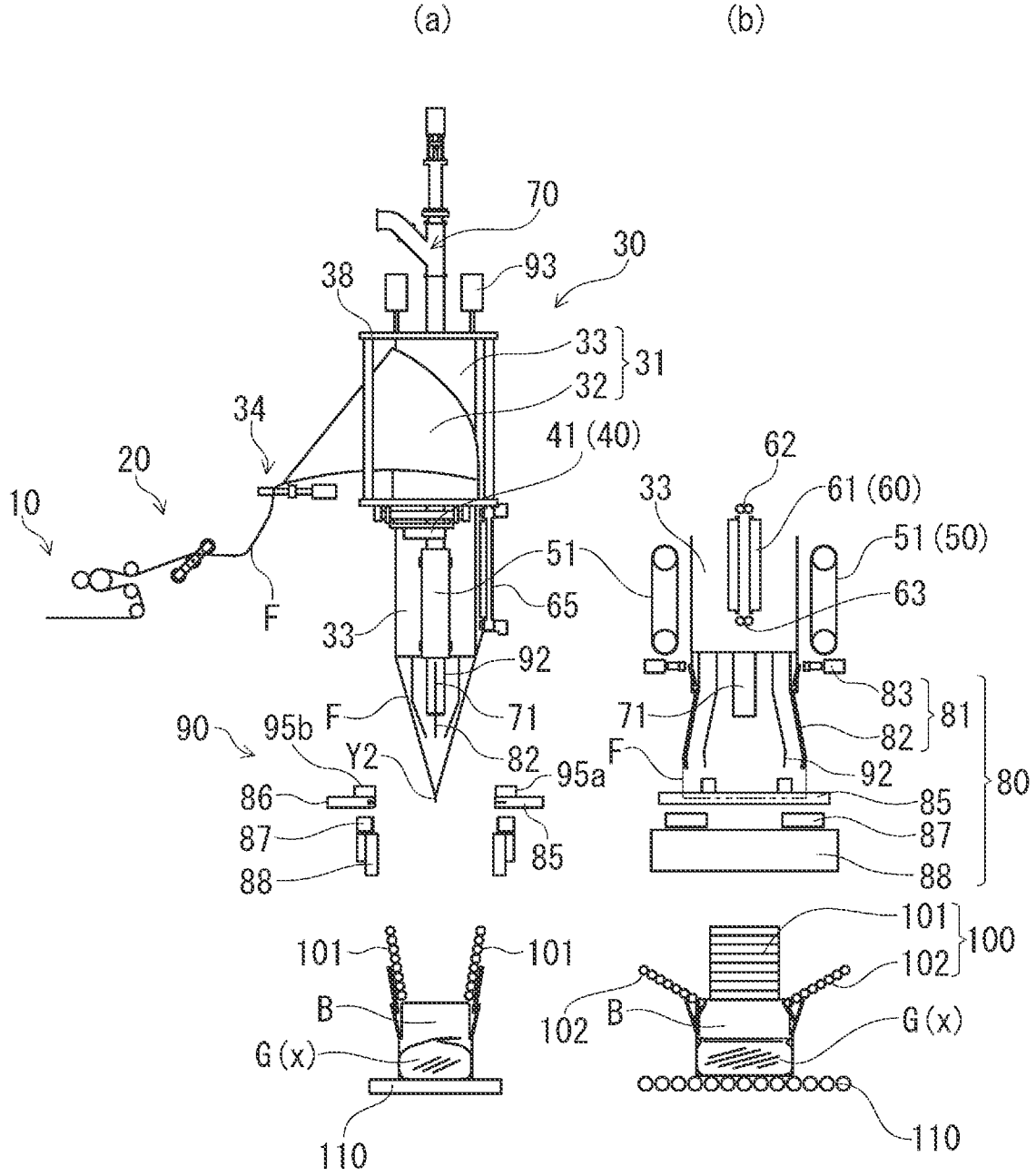
FIG. 13 are views illustrating a boxing step S9 of the manufacturing method of the film packaging bag G with contents, in which FIG. 13(*a*) is a side view and FIG. 13(*b*) is a front view.

FIG. 13 are views illustrating a boxing step S9 of the manufacturing method of the film packaging bag G with contents, in which FIG. 13(*a*) is a side view and FIG. 13(*b*) is a front view.

The boxing step S9 is a step in which the film packaging bag G is transferred from the bag supporting portion 100 and is packed in the cardboard box B.

First, the bag supporting portion 100 swings the roller conveyors 101, 102 downward so as to make the film packaging bag G fall downward. When the roller conveyors 101, 102 are swung downward, a space through which the film packaging bag G falls is formed between the roller conveyors 101, 102.

The cardboard box B is disposed in advance immediately below the film packaging bag G. The cardboard box B is carried into the filling/packaging portion 8 in the state with the upper lid open (in the state where the outer flap and the inner flap are upright perpendicularly).

When the roller conveyors 101, 102 are swung downward, they abut to an inner surface of the upper lid of the cardboard box B (outer flap, inner flap) and push up the upper lid to the outer side.

As illustrated in FIGS. 13, when the roller conveyors 101, 102 are swung downward, the film packaging bag G slides down along the roller conveyors 101, 102 and is accommodated in the cardboard box B. At this time, the film packaging bag G is accommodated in the cardboard box B in little contact with the upper lid of the cardboard box B. Since the film packaging bag G is not caught or rubbed by the upper lid of the cardboard box B, a scratch or a pinhole is not generated in the film packaging bag G. After the film packaging bag G falls, the roller conveyors 101, 102 are swung downward again and take a substantially horizontal attitude.

Then, the cardboard box B accommodating the film accommodating bag G is carried out of the bag-making/filling/packaging portion 6.

As described above, the step of manufacturing the film packaging bag G with contents is completed.

The vertical bag-making/filling/packaging machine 1 cancels the action of the film tension releasing step S6 for performing the manufacturing step of the subsequent film packaging bag G. First, the rotating belt 51 is moved inward in the lateral direction and is brought into close contact with the pipe portion 33 (film F). Then, the driven rollers 21, 23 are brought into close contact with the film F, and a tension is given to the film F. Moreover, the movable bar 36 is detached from the fixed bar 35 so that the film F can be carried.

Then, the new cardboard box B is carried into immediately below the bag supporting portion 100.

The vertical bag-making/filling/packaging machine 1 repeats the step of manufacturing the film packaging bag G with contents. The vertical bag-making/filling/packaging machine 1 repeats the steps from the film forming step S1 to the boxing step S9.

Thus, the vertical bag-making/filling/packaging machine 1 continuously manufactures a plurality of the film packaging bags G with contents.

As described above, the vertical bag-making/filling/packaging machine 1 includes the square-bottom sealing portion 90 which expands the bottom part of the film F (bag body) from the inside to a square (rectangle) and thermally seals it so as to form the square bottom surface G4.

Therefore, the film packaging bag G with the contents X filled therein can be manufactured efficiently by forming the bottom surface G4 without wrinkles. Particularly, even when the film F is a low-toughness film or when the film packaging bag G with a large capacity is to be formed, the film F can be folded with the square bag bottom without generating wrinkles.

Even in the case of food which is solidified when the contents X are cooled, since the film packaging bag G does not have the both corner parts, the contents X can be taken out easily. Therefore, wasteful disposal of the contents can be eliminated.

The four guide rods 92 brought into contact with the inner surface of the film F are provided, and the four guide rods 92 are moved to the four corner directions. Therefore, the bottom part of the film F can be folded into the bottom surface G4 and the flap G5.

Since surface areas of the four guide rods 92 are small, there is little possibility that the contents adhere thereto. Therefore, a washing frequency of the guide rods 92 can be lowered. Moreover, the four guide rods 92 can be attached/removed easily, which is excellent in maintenance performance.

The film conveying portion 50 conveys the film F in the downward direction in accordance with the folded amount of the flap G5 (both corner parts) when the four guide rods 92 move from the retreated position Q to the operating position P. Therefore, the bag bottom can be folded without generating wrinkles on the bottom part of the film F.

The guide-rod driving portion 93 raises and moves the four guide rods 92 to the retreated position Q, which is on the inner side in the four corner direction and is apart from the square-bottom heater 94, so as to disable contact with the inner side of the film F. Therefore, the four guide rods 92 do not inhibit the formation of the lateral seal Y.

The vertical bag-making/filling/packaging machine 1 performs weighing of the content X by the weighing portion 40 at the same time as the filling of the content X. At this time, the vertical bag-making/filling/packaging machine 1 releases (loosens) the tension applied to the film F by the film tension releasing portion 20. Moreover, the film F is held on the bag making guide 31 by the film clamp 34.

Thus, the weighing portion 40 can measure the weight change of the film F suspended from the bag making guide 31 without being influenced by the tension of the film F. That is, the weighing portion 40 can accurately weigh the content X filled in the film F (weight measurement). Therefore, the vertical bag-making/filling/packaging machine 1 can fill a constant amount of the content X in the film packaging bag G.

Thus, the vertical bag-making/filling/packaging machine 1 can continuously manufacture the film packaging bag G excellent in quantitativity of the content X.

Since the bag supporting portion 100 supports the film packaging bag G by the roller conveyors 101, 102 and conveys it toward the cardboard box B, efficiency of a packing work can be improved.

Moreover, since the roller conveyors 101, 102 opens the upper lid of the cardboard box B widely, the film packaging bag G can be accommodated in the cardboard box B without touching the upper lid. Therefore, occurrence of a pinhole and the like in the film packaging bag G can be prevented.

The present invention is not limited to the aforementioned embodiment but includes those with various modifications added to the aforementioned embodiment within a range not departing from the gist of the present invention. That is, specific shapes, configurations and the like cited in the aforementioned embodiment are only examples and capable of appropriate changes.

The film F is not limited to a band shape. The film F may be an inflation film. When the inflation film is used, a directional change roller or the like is used instead of the bag making guide 31.

The film packaging bag G may be formed of a plurality of sheets of band-shaped film.

The content X is not limited to a liquid or a fluid but may be a liquid or a fluid containing a solid. Moreover, the content X may be only a solid such as a food and a snack.

The roller conveyors 101, 102 of the bag supporting portion 100 may be belt conveyors. The conveyor 110 may be a belt conveyor.

The accommodating box is not limited to a cardboard box. The accommodating box may be a plastic container or an 18-liter metal can.

The film packaging bag G with contents is not necessarily accommodated in an accommodating box such as the cardboard box B. The film packaging bag G with contents may be placed on the conveyor 110 as it is and carried out from the vertical bag-making/filling/packaging machine 1 without being put in the accommodating box. In this case, a belt conveyor is used for the conveyor 110, not the roller conveyor.

The number of the nozzles 71 of the filling portion 70 is not limited to one. It may have both a large-diameter nozzle and a small-diameter nozzle. The large-diameter nozzle and the small-diameter nozzle may have shutters, respectively, and can open/close the shutters individually.

In the first half of the content filling/weighing step S7, the content X is discharged by opening the respective shutters of the large-diameter nozzle and the small-diameter nozzle (the loaded amount is increased). In the second half of the content filling/weighing step S7 (particularly before the filling is stopped), the shutter of the large-diameter nozzle is closed, and the content X is discharged only from the small-diameter nozzle (the loaded amount is suppressed).

Since the filling portion 70 includes the large-diameter nozzle and the small-diameter nozzle, filling time can be shortened. Moreover, since the content X is discharged only from the small-diameter nozzle before the filling is stopped, a filling error when the filling is stopped is made smaller, and the weight of the content X (filled amount) can be made more accurate (constant).

As the film F, a dry laminate film in which high-strength films such as nylon and polyester are laminated may be used. Those in which a plurality of films is laminated in a state movable with respect to each other may also be used. Thereby, the film packaging bag G with high mechanical strength can be manufactured.

REFERENCE NUMERALS

1 Vertical bag-making/filling/packaging machine
2 Apparatus frame
5 Film supplying portion
6 Bag-making/filling/packaging portion
7 Bag making portion
8 Filling/packaging portion
10 Conveying roller pair
11 Driving roller
12 Driven roller
13 Driving motor
20 Film tension releasing portion
21, 22 Driven roller
22*c* Rotating shaft
23 Driven roller
25 Roller moving portion
26 Supporting member
27 Air cylinder
30 Bag-making guide unit
31 Bag-making guide
32 Sailor suit-like portion
33 Pipe portion
34 Film clamp
35 Fixed bar
36 Movable bar
37 Air cylinder
38 Support frame
40 Weighing portion
41 Load cell
50 Film conveying portion
51 Rotating belt
60 Vertical sealing portion
61 Vertical heater
62, 63 Guide roller pairs
65 Roller support frame
70 Filling portion
71 Nozzle
72 Shutter
80 Lateral sealing portion
81 Flattening molding portion
82 Guide rod (Second guide rod)
83 Air cylinder (Second-guide-rod driving portion)
84 Lateral heater
85, 86 Heater bar
87 Wrinkle removing portion
88 Deaerating plate
89 Cutter
90 Square-bottom sealing portion
91 Square-bottom molding portion
92 Guide rod (First guide rod)
93 Guide-rod driving portion (First-guide-rod driving portion)
94 Square-bottom heater
95, 96 Heater bar
97 Square-bottom heater-bar driving portion
100 Bag supporting portion
101, 102 Roller conveyor
110 Conveyor (Bag-body carrying-out portion)
F Film
Fr Roll
G Film packaging bag (Bag body)
G1 Front surface
G2 Rear surface
G3 Side surface
G4 Bottom surface
G5 Flap (Both corners)
T Vertical seal
Y, Y1, Y2 Lateral seal
K Square-bottom seal
X Content
B Cardboard box (Accommodating box)

The invention claimed is:

1. A vertical bag-making/filling/packaging machine, comprising:

a film supplying portion which lets out a film from a roll;

a bag-making guide which folds the film into a tubular shape and changes a conveying direction downward;

a vertical sealing portion which thermally seals side edges of the film to each other in an up-down direction so as to make the film into a tubular shape;

a film conveying portion which conveys the film downward;

a filling portion which loads a content into an interior of the film;

a lateral sealing portion which thermally seals the film in a left-right direction so as to make a bag body;

a square-bottom sealing portion which expands a bottom of the bag body to a rectangular shape from an inside and thermally seals the bottom to make a rectangular bottom surface; and a cutter which cuts off the bag body from the film, wherein the square-bottom sealing portion comprises:

a square-bottom molding portion which expands a bottom part of the bag body into a rectangular shape from the inside and folds both corner parts of the bag body into a triangle; and a square-bottom heater which thermally seals the both corner parts in a front-back direction, the square-bottom molding portion comprises:

four first guide rods in contact with an inner surface of the film; and a first-guide-rod driving portion which moves the four first guide rods in four corner directions, the lateral sealing portion comprises:

a flat molding portion which flattens the film; and a lateral heater which sandwiches the film in a left-right direction and thermally seals the film, the flat molding portion comprises:

two second guide rods brought into contact with the inner surface of the film; and a second-guide-rod driving portion which moves the two second guide rods in the left-right direction, when the first-guide-rod driving portion moves the four first guide rods outward in the four corner directions, the second-guide-rod driving portion moves the two second guide rods inward in the left-right direction, and when the first-guide-rod driving portion moves the four first guide rods inward in the four corner directions, the second-guide-rod driving portion moves the two second guide rods outward in the left-right direction.

2. The vertical bag-making/filling/packaging machine according to claim 1, wherein the square-bottom heater thermally seals the both corner parts on an upper surface of the lateral sealing portion in the front-back direction.

3. The vertical bag-making/filling/packaging machine according to claim 1, wherein the first-guide-rod driving portion:

lowers and moves the four first guide rods to an operating position which is on an outer side in the four corner direction, is close to the square-bottom heater and is in contact with an inner side of the film; and raises and moves the four first guide rods to a retreated position which is on an inner side in the four corner direction, is apart from the square-bottom heater and is not in contact with the inner side of the film.

4. The vertical bag-making/filling/packaging machine according to claim 3, wherein the film conveying portion conveys the film in a downward direction in accordance with a folded amount of the both corner parts when the four first guide rods move from the retreated position to the operating position.

5. The vertical bag-making/filling/packaging machine according to claim 1, comprising:

a film clamp which holds the film on the bag-making guide;

a film tension releasing portion which loosens the film laid between the film supplying portion and the bag-making guide; and a weighing portion which supports the bag-making guide and weighs the content.

6. The vertical bag-making/filling/packaging machine according to claim 5, wherein:

the weighing portion includes a pair of load cells; and the bag-making guide is laid over the pair of load cells.

7. The vertical bag-making/filling/packaging machine according to claim 1, comprising a pair of deaerating plates which is disposed immediately below the lateral sealing portion and regulates a thickness of the bag body when the lateral sealing portion is operated.

8. The vertical bag-making/filling/packaging machine according to claim 1, wherein:

the vertical bag-making/filling/packaging machine comprises a bag supporting portion disposed below the lateral sealing portion and supporting a bottom of the bag body when the lateral sealing portion is operated; and the bag supporting portion conveys the bag body toward a bag-body carrying-out portion after the cutter is operated.

9. The vertical bag-making/filling/packaging machine according to claim 8, wherein:

the bag supporting portion comprises a conveyor; and the conveyor is swung downward so as to slide the bag body down.

10. The vertical bag-making/filling/packaging machine according to claim 9, wherein:

the bag-body carrying-out portion conveys an accommodating box below the bag supporting portion; and the bag supporting portion swings the conveyor so as to open an upper lid of the accommodating box widely.

11. The vertical bag-making/filling/packaging machine according to claim 1, wherein the film is a co-extruded polyethylene multilayered film or a low-density polyethylene single-layered film.

12. A manufacturing method of a film packaging bag with contents, comprising:

a film forming step in which a film let out from a roll is folded into a tubular shape;

a vertical sealing step in which side edges of the film are thermally sealed to each other in up-down direction so as to form a tubular shape;

a film conveying step in which the film is conveyed downward;

a filling step in which the content is loaded into an interior of the film;

a lateral sealing step in which the film is thermally sealed in a lateral direction so as to make a bag body;

a square-bottom sealing step in which a bottom of the bag body is expanded to a rectangular shape from the inside and then thermally sealed to form a rectangular bottom surface; and a bag-body cutting-off step in which the bag body is cut off from the film, wherein the square-bottom sealing step comprises:

a square-bottom molding step in which four first guide rods in contact with an inner surface of the film are moved in a four corner directions, a bottom part of the bag body is expanded into a rectangular shape from the inside, and both corner parts of the bag body are folded into a triangle; and a square-bottom heater step in which the both corner parts are thermally sealed in a front-back direction, the lateral sealing step comprises:

a flat molding step in which two second guide rods in contact with the inner face of the film are moved in a left-right direction so as to flatten the film; and a lateral heater step in which the film is sandwiched in a left-right direction and thermally sealed, when the four first guide rods are moved outward in the four corner directions in the square-bottom molding step, the two second guide rods are moved inward in the left-right direction in the flat molding step, and when four first guide rods are moved inward in the four corner directions in the square-bottom molding step, the two second guide rods are moved outward in the left-right direction in the flat molding step.

13. The manufacturing method of the film packaging bag with contents according to claim 12, wherein, in the square-molding step:

the four first guide rods are lowered and moved to an operating position which is on an outer side in the four corner direction, is close to the square-bottom heater and is in contact with an inner side of the film; and the four first guide rods are raised and moved to a retreated position which is on an inner side in the four corner direction, is apart from the square-bottom heater and is not in contact with the inner side of the film.

14. The manufacturing method of the film packaging bag with contents according to claim 13, wherein, in the film conveying step, the film is conveyed in a downward direction in accordance with a folded amount of the both corner parts when the four first guide rods move from the retreated position to the operating position.

* * * * *